US007614600B1

(12) United States Patent
Smith et al.

(10) Patent No.: US 7,614,600 B1
(45) Date of Patent: Nov. 10, 2009

(54) UMBRELLA BASE WITH POWER SUPPLY

(75) Inventors: James C. Smith, Hayward, CA (US); David J. Taylor, 129 Sugar Creek La., Alamo, CA (US) 94507

(73) Assignee: David J. Taylor, Alamo, CA (US)

( * ) Notice: Subject to any disclaimer, the term of this patent is extended or adjusted under 35 U.S.C. 154(b) by 120 days.

(21) Appl. No.: 11/021,487

(22) Filed: Dec. 22, 2004

Related U.S. Application Data

(60) Provisional application No. 60/533,737, filed on Dec. 29, 2003.

(51) Int. Cl.
*A47B 97/00* (2006.01)

(52) U.S. Cl. ..... 248/519; 135/16; 248/910

(58) Field of Classification Search ..... 248/519, 248/523, 346.03, 346.01, 910; 135/16; 52/28, 52/40; 362/102; 174/53; 439/575, 654
See application file for complete search history.

(56) References Cited

U.S. PATENT DOCUMENTS

| | | | | | |
|---|---|---|---|---|---|
| 1,166,272 | A | | 12/1915 | Smithing | |
| 1,177,241 | A | | 3/1916 | Gay | |
| 1,579,649 | A | * | 4/1926 | Cushway | 362/134 |
| 2,658,225 | A | | 11/1953 | Bascom | |
| 3,228,317 | A | * | 1/1966 | Westman | 454/338 |
| 4,093,969 | A | | 6/1978 | Maynor, Jr. | |
| 4,145,044 | A | * | 3/1979 | Wilson et al. | 473/483 |
| 4,174,532 | A | | 11/1979 | Kelley | |
| 4,962,779 | A | | 10/1990 | Meng | |
| 5,007,811 | A | | 4/1991 | Hopkins | |
| 5,053,931 | A | * | 10/1991 | Rushing | 362/102 |
| 5,207,238 | A | * | 5/1993 | Rivera et al. | 135/16 |
| 5,213,122 | A | | 5/1993 | Grady, II | |
| 5,280,799 | A | | 1/1994 | Alajajian | |
| 5,291,908 | A | | 3/1994 | Grady, II | |
| 5,331,524 | A | | 7/1994 | Tseng | |
| 5,463,535 | A | | 10/1995 | Vest | |
| 5,611,614 | A | | 3/1997 | Morgan | |
| 5,713,554 | A | * | 2/1998 | Lai | 248/522 |
| 5,791,761 | A | | 8/1998 | Bryant et al. | |
| 5,979,793 | A | * | 11/1999 | Louis | 239/128 |
| 5,986,872 | A | | 11/1999 | Chaput | |
| 6,017,188 | A | * | 1/2000 | Benton | 416/5 |
| 6,267,481 | B1 | | 7/2001 | Yang | |
| 6,298,866 | B1 | * | 10/2001 | Molnar, IV | 135/16 |
| 6,305,659 | B1 | * | 10/2001 | Metelski | 248/519 |
| 6,367,494 | B1 | * | 4/2002 | Tung | 135/99 |
| 6,439,249 | B1 | | 8/2002 | Pan et al. | |
| 6,598,990 | B2 | | 7/2003 | Li | |
| 6,612,713 | B1 | | 9/2003 | Kuelbs | |
| 6,637,717 | B2 | * | 10/2003 | Li | 248/519 |
| 6,663,202 | B2 | * | 12/2003 | Spann | 312/249.12 |
| 6,692,135 | B2 | | 2/2004 | Li | |
| 6,739,566 | B1 | * | 5/2004 | Kao | 248/522 |
| 6,827,321 | B1 | * | 12/2004 | Murren et al. | 248/519 |

(Continued)

*Primary Examiner*—A. Joseph Wujciak, III
(74) *Attorney, Agent, or Firm*—Donald L. Beeson; Beeson Skinner Beverly, LLP

(57) ABSTRACT

An umbrella base is comprised of a body portion containing a power source for powering umbrella lights or electrical devices or appliances used around the umbrella or other furniture accessory held by the base. A power console is provided for use on or above the base to provide connectivity to the power supply.

13 Claims, 25 Drawing Sheets

U.S. PATENT DOCUMENTS 6,889,953 B2 * 5/2005 Harbaugh ..... 248/519
6,953,179 B2 * 10/2005 Lai ..... 248/522
7,021,598 B2 * 4/2006 Kao ..... 248/521
2003/0230331 A1 * 12/2003 Li ..... 135/910
2004/0069922 A1 * 4/2004 Wu ..... 248/519
2004/0228118 A1 * 11/2004 Peterson ..... 362/102
2005/0016571 A1 1/2005 Wu
2006/0120067 A1 * 6/2006 Kuelbs ..... 362/129
2006/0124157 A1 * 6/2006 Bayour ..... 135/16

* cited by examiner 80
60
54
40
50
42
32
25
43
65

80
50
52
70
L
51
61c
61b
LOGO
40
42
32a
65
L
73
42
32
53
25
60
62
27
56

UMBRELLA BASE WITH POWER SUPPLY

CROSS-REFERENCE TO RELATED APPLICATIONS

This application claims the benefit of Provisional Application No. 60/533,737, filed Dec. 29, 2003.

BACKGROUND OF THE INVENTION

The present invention generally relates to the use of umbrellas, and in particular, to umbrella bases used to hold umbrellas in an upright position.

Outdoor and patio umbrellas (collectively referred to as patio umbrellas) are widely used in personal, recreational and commercial settings. Typical commercial purchasers of patio umbrellas include hotels, resorts, restaurants, cafes, pubs and coffee houses. Because of their widespread use and the visual exposure they provide to users and passers-by, patio umbrella's have been popular as a media for corporate advertising. As more people spend time outside and become more educated about the harmful effect of the sun's direct rays, the demand for patio umbrella's is likely to increase along with the opportunity for providing advertising centered around the patio umbrella. Heretofore, such advertising has been limited to imprinting or otherwise incorporating company names, product names, logos and the like directly on the umbrella's fabric covering, where the advertising is within normal sight lines of persons situated at a distance from the umbrella, however, where the advertising cannot be easily viewed by persons close in, such as persons seated under the umbrella.

Therefore, there is a need for increasing the opportunities for corporate and other types of advertising associated with the patio umbrella that have not heretofore existed. There is also a need to provide a vehicle for corporate advertising associated with patio umbrella's that is visually prominent and within sight-lines of people seated or standing underneath or close to the umbrella in a manner not provided by conventional advertising specialty umbrella's. These needs are fulfilled by the present invention by means of a novel umbrella base capable of providing a visible advertising message beneath the umbrella held by the base.

There is also a need for an improved umbrella base that can easily be moved from one location to the other and that can be adapted to support umbrellas of different sizes and weights and in different weather environments. Weight is an important issue for patio umbrella bases. A user or manufacturer must normally determine the weight required to support a patio umbrella for given conditions. This determination depends on several variables, including the weight and span of the patio umbrella to be supported, and the location and environmental conditions in which the patio umbrella is to be used. For example, a heavier base would be more suitable for a patio umbrella that is to be used in an exposed outdoor area where wind loads are frequently high. On the other hand, if the patio umbrella is to be used in a relatively sheltered or non-exposed area, such as inside a large building or sheltered area, or underneath a table, a lighter base would suffice. Too much weight is undesirable because the base would be excessively heavy and difficult to move. The added weight may also lead to increased shipping costs. Insufficient weight would make the umbrella susceptible to being toppled by wind or other forces.

Heretofore, different umbrella bases having different weights have typically been designed for different use environments. For example, umbrella bases using a form of cast iron or metal bottom plate have been popular for supporting outdoor patio umbrellas that are quite large and heavy and that require a heavy and stable umbrella base for adequate support. A conventional cast iron base will typically weigh about fifty to seventy pounds. Such weight is adequate to support some patio umbrellas in some environments, however, it may be inadequate depending on weather conditions and the umbrella size. Also, metal bases are susceptible to corrosion which results not only in the deterioration of its outer appearance, but also creates a problem when rust particles stain the surrounding support surfaces such as wood or concrete. Protective coatings such as rust resistant paint and even high cost powder coatings have been used to help alleviate this problem, however, in high traffic areas repeated contact with tables and chairs can cause scratches in the surface coatings allowing the metal beneath the protected surface to rust.

Another known form of an umbrella base is a simple, typically hemispherical block of concrete having an imbedded vertical pipe for receiving the end of an umbrella. Such bases are heavy, unattractive and difficult to move, and not well adapted for many use environments.

Yet another umbrella base design that has heretofore been used is a base that is rotationally or blow molded from plastic to form a one piece hollow body similar in construction to a milk container. This molding process produces low cost, rust resistant parts, however, the parts generally are large and bulky and cosmetically unattractive. Also, they are produced with a relatively thin and uniform wall thickness making it difficult to attach the necessary structural tubing to hold the umbrella shaft. Rotationally or blow molded bases are usually located in a predetermined location and then filled with suitable fluid ballast such as water through a small fill opening to provide the weight necessary to support the umbrella. Once filled, they are very difficult to move without the draining of the fluid ballast.

A need further exists for an umbrella base that can be easily moved. The difficulty in moving conventional umbrella bases is a significant drawback. As the sun transitions throughout the day, the shade from the umbrella moves from one location to another. If tables and chairs have been arranged below the umbrella to shade the early morning sun, by afternoon these chairs and tables are now in the direct sunlight. The umbrella themselves have been designed to allow for some sun correction by allowing the user to tip or angle the umbrella to offset the suns movement. However, because of the difficulty in moving existing umbrella bases and because the offset angle of the umbrella only offers minimal shade adjustments, users usually need to move their table and chairs to the new shaded area as the day progresses.

There is also a need to provide a convenient source of power to an umbrella for umbrella lights and/or to power electrical devices used by persons using the umbrella. The use of umbrella lighting is increasing prevalent. For example, small strings of small lights have been adapted to the underside and perimeter of the umbrella shade to provide evening lighting and a decorative environment. The lights in these umbrellas are normally connected via a long extension cord to an electrical wall outlet, usually a 120-volt circuit. These cords connecting the power source to the lights usually extend along the concrete or patio surface, wrap around the umbrella base and up the pole to connect to the lights. This can create a dangerous situation due to the traffic, tables and chairs that surround each umbrella base where people can trip or possibly damage the electrical cord. In addition, many umbrellas are used around water sources such as pools, pond, lakes etc.

that could cause serious, if not deadly, results if the umbrella was tipped or blown over into the water source causing an electrical hazard.

Electrical power at the umbrella for powering electrical devices and appliances has also not heretofore existed without providing extension cords or a connection to a power supply external to the umbrella. A source of power at the umbrella would be particularly useful for users of lap top computers, portable fax machines, and other electronic communications devices, and users of various electrical appliances that might be employed while sitting underneath an umbrella, such as heaters, fans, radios, blenders, etc.

The present invention fulfills these needs and overcomes the above-mentioned shortcomings of previous umbrella bases by providing an improved and versatile umbrella base that provides a source of electrical power to users of the umbrella and a facility for connecting up to the source of power without the need for lengthy extension cords, or power connections external to the umbrella held by the base.

SUMMARY OF INVENTION

The present invention provides an umbrella base having a body portion, an umbrella shaft holding structure accessible from the top of the body portion to receive the support shaft of an umbrella, and a power source contained in the body portion, suitably one or more batteries, but which could be any other source of electrical power. A conductive path is provided from the power source through the body portion of the umbrella base for providing a power output at or near the umbrella holding structure which can be to used to power lights on or associated with the umbrella or umbrella base, or to power any electrical device or appliance that may need electrical power. It is contemplated that an umbrella base containing a source of power in accordance with the invention could be used to support furniture accessories other than an umbrella, such as a table top or the like.

In one aspect of the invention the power output of the umbrella base is connected to a power console at or near the base for providing convenient power connectors for users of the umbrella (or other furniture accessory). The power console can be mounted on top or above the umbrella base preferably about the umbrella shaft holding structure, or on a table top above the umbrella holding structure. Examples of uses for the power source include umbrella lighting and powering electronic device and appliances, such as lap-top computers, fax machines, heaters, fans, and stereos that might be used under or near the umbrella held by the base. The power console can also be used for lighting advertising messages associated with the umbrella or umbrella base.

The optional power console of the invention is comprised of a housing containing electrical components and having a center collar structure adapted to either fit around the umbrella holding structure of the umbrella base or around an umbrella shaft above the umbrella holding structure. Preferably the console has a donut-shaped housing having accessible connectors for plugging electrical devices into the console.

The body portion of the umbrella base can be provided with a visible billboard surfaces on which advertising indicia can be provided for advertising a company, organization, product, service or the like. Preferably, the billboard surface is a top surface of the body portion, but could be provided on sidewall surfaces as well. If desired, the billboard surface can be lit by lighting powered by the power supply in the body portion of the base.

In another aspect of the invention, the body portion of the umbrella base is comprised of a ballast housing assembly which includes a lower ballast holding portion (sometimes referred to herein as "lower housing") having at least one ballast cavity in which the power source is located, and which, can otherwise be filled with a ballast material, such as water, sand, steel shot, iron, lead, concrete, cement. The housing assembly further includes a top cover portion (sometimes referred to as "housing cover") that removably fits onto the lower portion of the housing assembly to cover the at least one ballast cavity. The removable cover portion provides access to the ballast cavity without the need for narrow fill openings for the ballast material, and permits aggregate ballast materials such as sand or cement to be distributed evenly within the cavity. The ballast cavity is optionally divided into smaller cavities such as by partition walls disposed in the cavity. Multiple cavities facilitate even distribution of the ballast material within the lower ballast holding portion of the housing and minimize shifting of the ballast material within the base when the base is moved or tipped. They also facilitate the placement of batteries or other power supplies in the ballast cavities, and possibly the use of other relatively small easy to handle ballast containers sized and shaped to fit within the cavities. Specific cavity volumes can also be provided to predetermine the amount of ballast weight that will be added for a given ballast material.

Therefore, a primary object of the present invention is to provide an improved umbrella base that can provide a source of power to the user of an umbrella (or other furniture accessory) held by the base. It is another object of the invention to provide such an umbrella base that can be used with different sized umbrellas and in different use environments. It is a further object of the invention to provide convenient connectivity to the source of power provided by the umbrella base. One or more of the foregoing objects may be attained in a particular embodiment of the invention and a particular embodiment of the invention need not attain all of the foregoing objects. Also, other objects of the present invention will become apparent to those skilled in the art from the following description, the accompanying drawings and the appended claims.

DETAILED DESCRIPTION OF THE ILLUSTRATED EMBODIMENTS

The present invention provides a novel umbrella base of the type used to hold the shaft of an umbrella such as a patio umbrella. In its various aspects the umbrella base of the invention provides mobility, can be stabilized once it reaches its predetermined location, has operative components that can be easily be removed and attached, such as for filling the base with a ballast material, and provides an easily viewed advertising display, including an interchangeable display. An umbrella base is also described that is adapted to contain a power source such as batteries and power feeds for users of the umbrella and an easily accessed power console.

Figure 1:
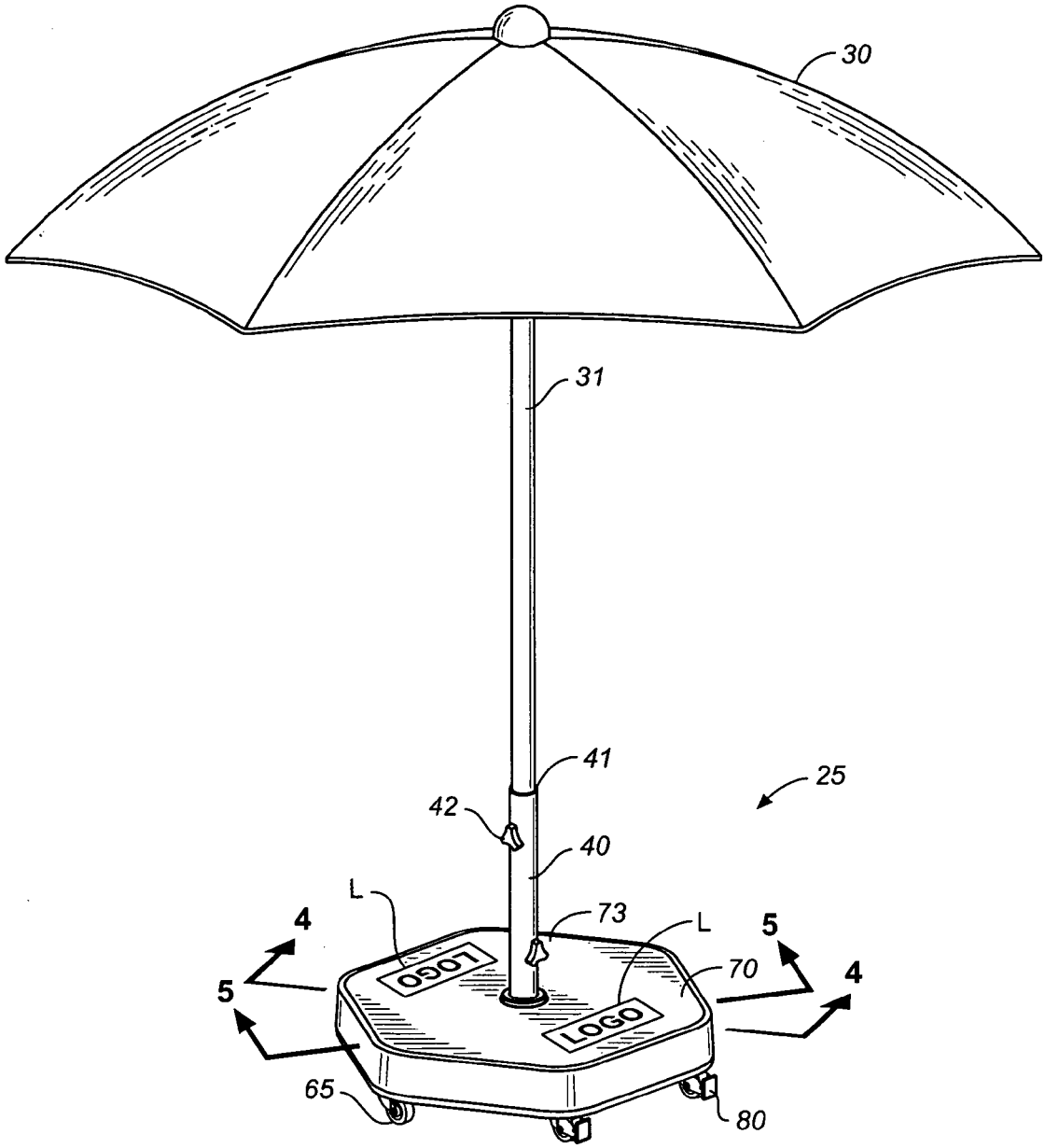
FIG. 1 is a perspective view of one embodiment of an umbrella base according to the present invention, shown supporting an umbrella shade.

Referring now to the drawings, FIGS. 1-11 show an embodiment of the invention and components thereof, wherein the umbrella base is a rolling umbrella base which is generally hexagonal in shape, which displays an advertising message, and which is capable of being locked in a set position after it has been moved. Base 25 is comprised of a body portion in the form of housing assembly 27, and an umbrella holding structure associated with the housing assembly for holding the support shaft 31 of an umbrella shade 30 as shown in FIG. 1. The umbrella holding structure is provided in the form of a cylindrical support pipe 40 having an open top end 41 for receiving the umbrella shaft. Shaft locking mechanisms such as thumb screws 42 are suitably provided on the support pipe to allow the umbrella support shaft to be secured within the pipe. The support pipe can suitably be made from schedule 40 steel pipe which is powder-coated for protection against rust, or from other materials, such as stainless steel, aluminum, fiberglass or plastic.

Figure 4:
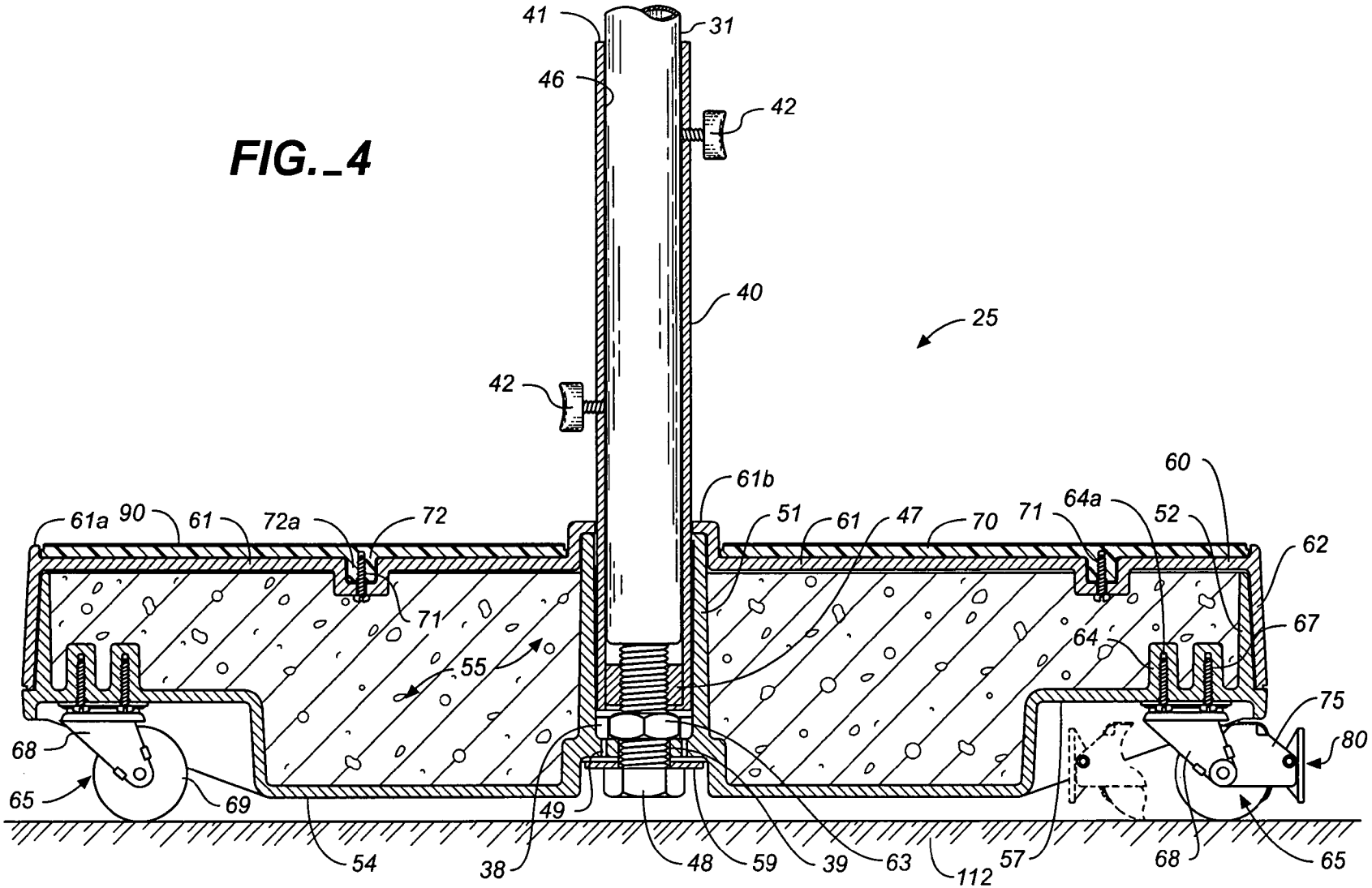
FIG. 4 is a cross-sectional view thereof taken along lines 4-4 in FIG. 1.
Figure 5:
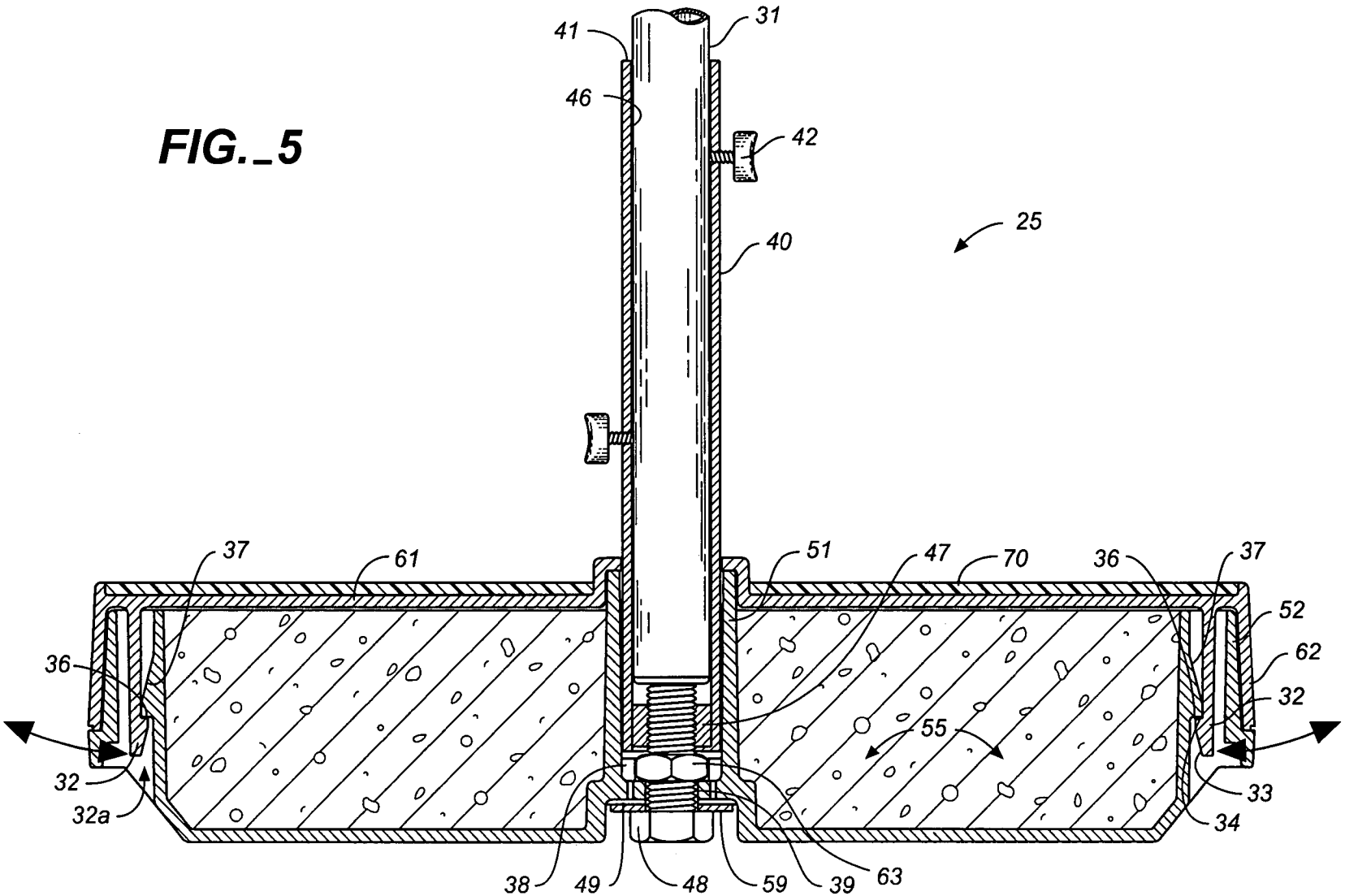
FIG. 5 is a cross-sectional view thereof taken along lines 5-5 in FIG. 1.
Figure 6:
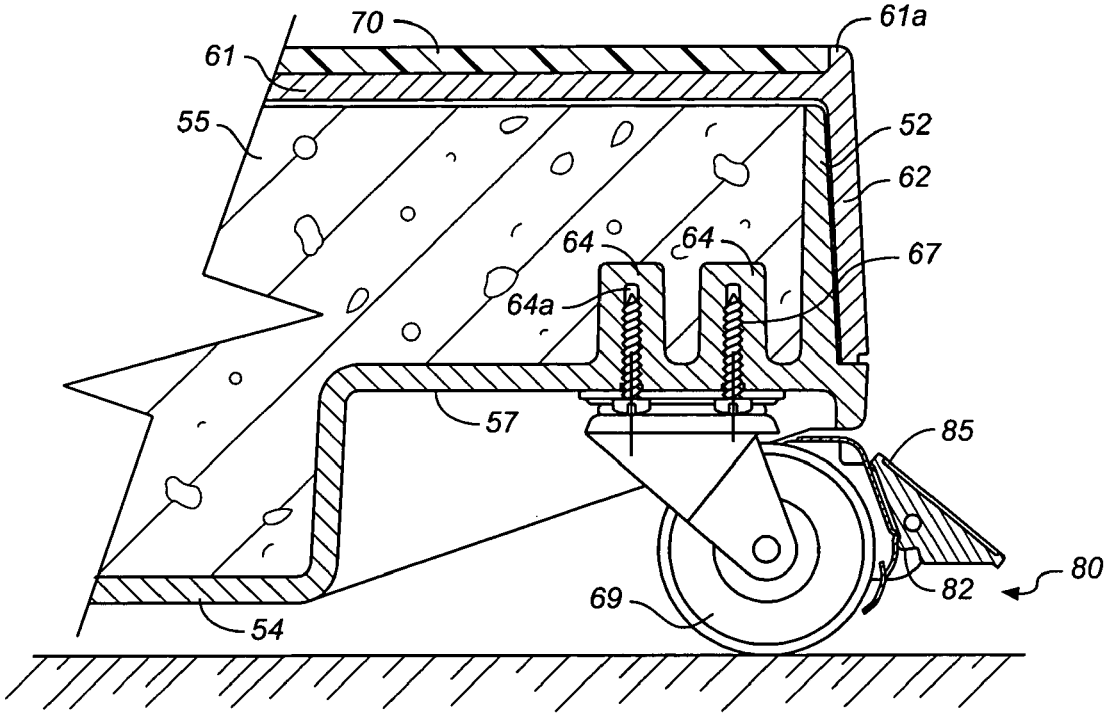
FIG. 6 is a fragmentary cross-sectional view thereof showing one locking wheel caster in the unlocked position.
Figure 7:
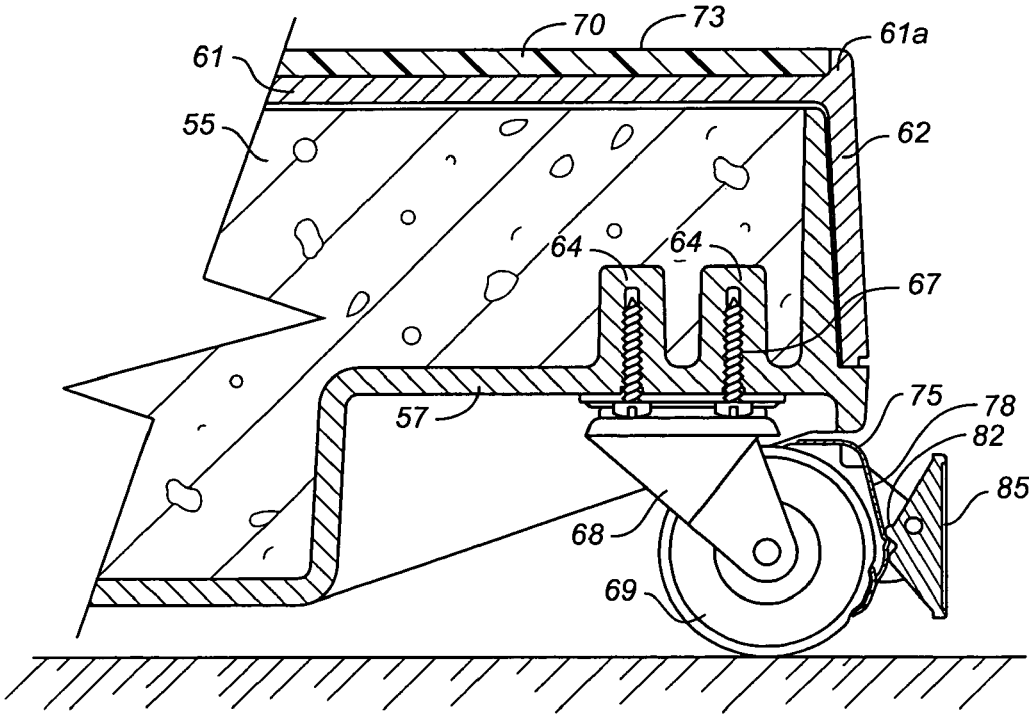
FIG. 7 is fragmentary cross-sectional view thereof showing one locking wheel caster in the locked position.

The housing assembly 27 is seen to comprise a lower portion 50 (sometimes referred to as the "lower housing") and top cover portion 60 (sometimes referred to as the "housing cover"), both of which are preferably fabricated of an injection or structural foam molded polymer with UV resistance, such as high-density polyethylene (HDPE), but which could be fabricated of other materials. As shown in FIGS. 4 and 5, the lower housing 50 has an internal compartment bounded by bottom wall 54, outer sidewalls 52, and a central cylindrical retaining sleeve structure 51 that extends upwardly from bottom wall 54 for receiving support pipe 40. This internal compartment is divided into separate ballast cavities 53 by upstanding partition walls 56. At least one, and preferably all of these ballast cavities are filled with a ballast material, which in FIGS. 4-7 is shown as concrete and denoted by the numeral 55, but which could be any other suitable ballast material selected by the user, such as, water, sand, gravel, steel shot, iron, lead, or cement. By providing defined cavity volumes, the user can add different defined weights to the umbrella base by selecting from different ballasts or ballast materials. For example, assuming the total volume of the three cavities is one cubic foot, the following are examples of weights that can be added to the base depending on the ballast material selected: 62 lbs using one cubic foot of water, 100 lbs using one cubic foot of dry sand, 137 lbs using one cubic foot of concrete, or 193 lbs using one cubic foot of Portland cement. The total weight of the umbrella base would be the sum of the added ballast weight and the weight of the other components of the base. If, for example, the other components weighs 30 lbs and the ballast cavity has a volume of one cubic foot, by selecting either water, dry sand, concrete, or Portland cement as a ballast material, the umbrella base can be made to weigh 92 lbs or 130 lbs or 167 lbs or 223 lbs, respectively. Such a selection would be made according to the nature of the umbrella to be held and its use environment. For example, the ability to add a heavy ballast weight would allow for the use of heavier umbrellas having large diameter canopies (not shown), and for the holding umbrellas in environments which present significant wind loads.

As later described, the ballast cavities of the lower housing portion of the housing assembly can be configured to receive a ballast container which is filled with a ballast material or contains a ballast weight. Such containers may be a rigid containers of a fixed size and shape or non-rigid containers such as cloth or plastic bags for holding a volume of ballast material that fits within the ballast cavities. It is also understood the lower housing 50 can be constructed with no partition walls such that there is only one large ballast cavity. It will further be appreciated that more or less partition walls can be used to segment the ballast cavity of the housing assembly into a greater number or lesser number of ballast cavities than the number of ballast cavities illustrated in the drawings.

Figures 2, 3:
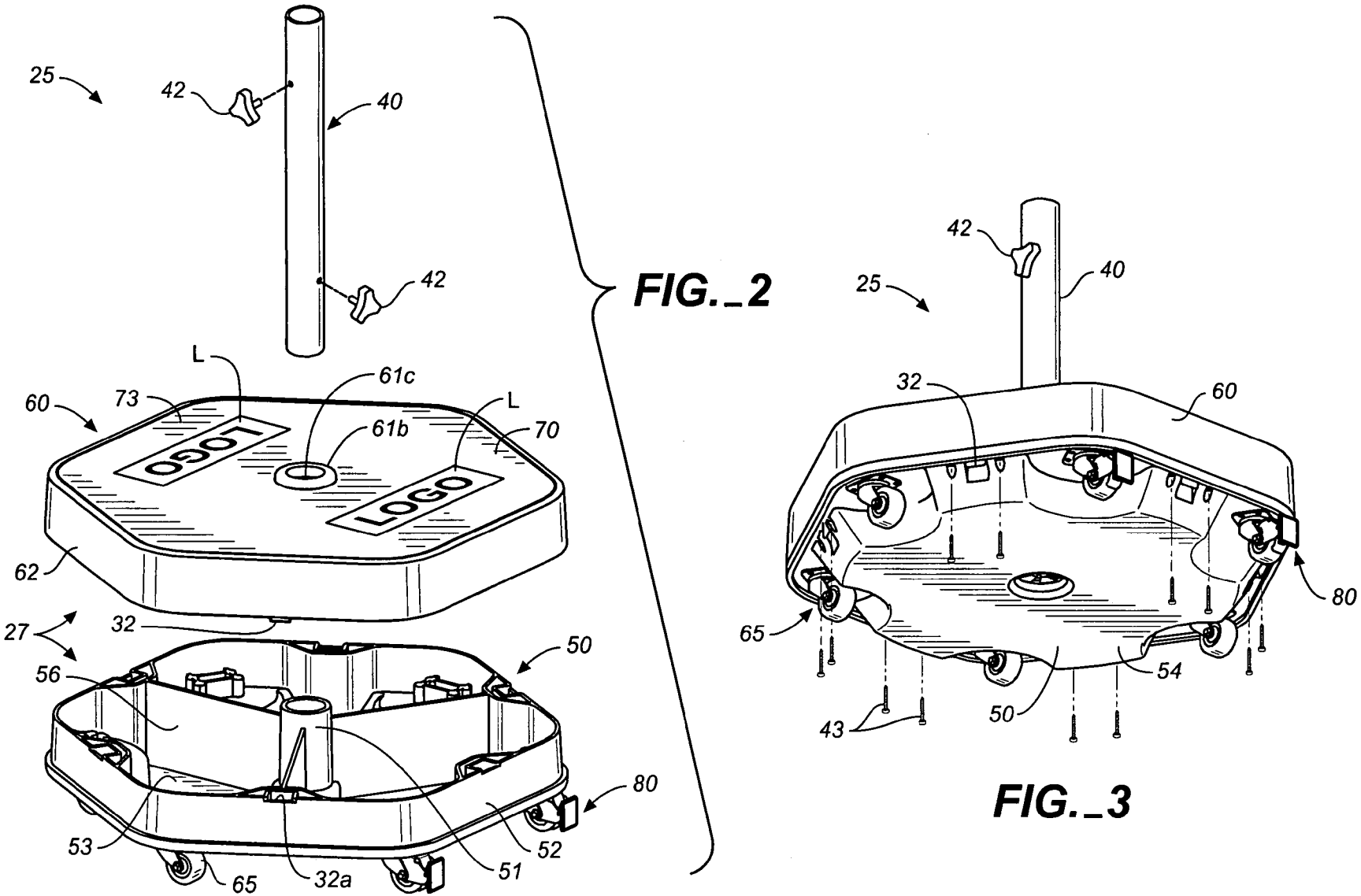
FIG. 2 is an exploded top perspective view thereof.
FIG. 3 is a bottom perspective view thereof showing housing attachment screws exploded therefrom.

The top cover portion 60 of housing assembly 27 has a flat, laterally extending top wall 61, which includes a raised perimeter rim 61*a* and a raised central collar 61*b* that receives the top portion of the upwardly projecting retaining sleeve 51 of the lower housing 50, when the housing cover is placed on the lower housing. As best shown in FIG. 3, top cover portion 60 also includes outer downwardly extending sidewalls 62 adapted to slide over and engage the sidewalls 52 of the assembly's lower housing 50 to provide a continuous and visually pleasing skirt around the perimeter of the umbrella base that inhibits entry of moisture into the ballast cavities through the perimeter of the base. For uses in particular wet environments, it may be desirable to add a sealing material, such an adhesive backed open or closed cell foam or tubing, between the sidewalls 52, 62 of the two halves of the housing assembly.

The top cover and lower portion of the housing assembly are held together by finger releasable snap latches 32 spaced around the perimeter of the housing cover, which insert into corresponding latch channels 32*a* formed on the perimeter of the lower housing portion. As shown in FIG. 5, each of the snap latches 32 on the housing assembly's top cover is suitably provided in the form of molded-in resilient latch member having a lead-in tapered surface 33. Upon placing the top cover 60 over the lower housing portion 50, this lead-in surface rides up on the ramped surface 37 formed in the latch channel 32*a* of the lower housing portion, causing the latch member to deflect outward until it snaps over the back edge of the ramped surface into the locked position shown. In their locked position, the ends of the snap latches are accessible from the bottom the housing assembly as shown in FIG. 3, so that top cover 60 can be unlocked from the bottom housing 50 by pressing the snap latches outwardly one-by-one to disengage them from their locked condition. Added securement for these separable parts of the housing assembly can be provided by means of screws 43 inserted through the bottom of the lower housing portion (see FIG. 2). This additional screw attachment will prevent possible breakage of the snap latches 32 and/or unintended opening of the housing assembly in unforeseen hostile conditions, for example, if the umbrella base were to blow over in a storm.

The umbrella base 25 is also provided with casters to allow the base to be moved from one location to another with minimum physical effort. The illustrated casters are standard off-the-shelf wheel casters 65 having a frame 68, suitably fabricated of zinc plated forged steel, and caster wheels 69, which are preferably non-marking, shock resistant polyurethane wheels for economy and long life. As best shown in FIG. 4, the wheel casters 65 are mounted in perimeter recesses 57 formed in the bottom wall 54 of the lower housing 50. The wheel casters are mechanically attached to the lower housing by self-taping screws 67, which tap into holes 64*a* in hole bosses 64 located behind the bottom wall recesses 57.

As illustrated in FIGS. 1-7 and 11, at least one and suitably two or more of the wheel casters 65 of the umbrella base have a locking mechanism for locking the caster wheels 69 before and after the base is moved. By locking the wheel casters, the umbrella base can be stabilized against unwanted movement at its set location. The locking mechanism is preferably provided in the form of a brake assembly 80 installed on the casters as best illustrated in FIG. 8.

Figure 8:
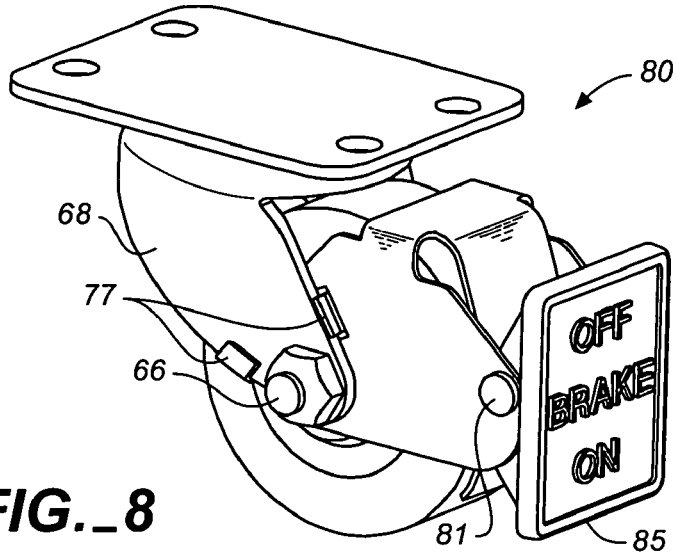
FIG. 8 is a top perspective view of a locking wheel caster for use on an umbrella base according to the invention shown in the locked position.
Figure 9:
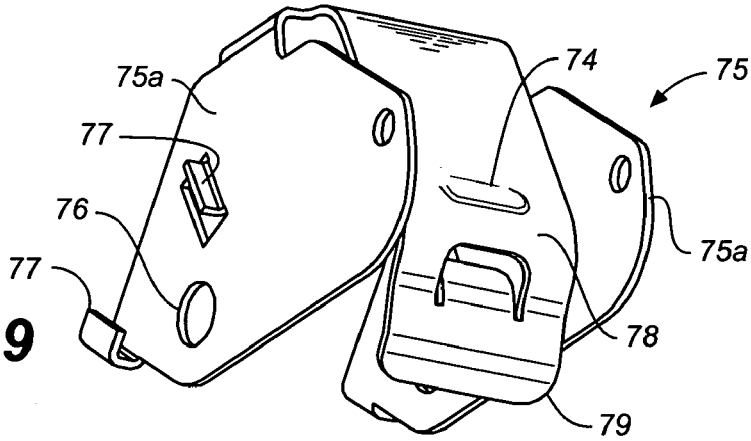
FIG. 9 is a bottom perspective view of a wheel lock bracket for the locking wheel caster shown in FIG. 8.
Figure 10:
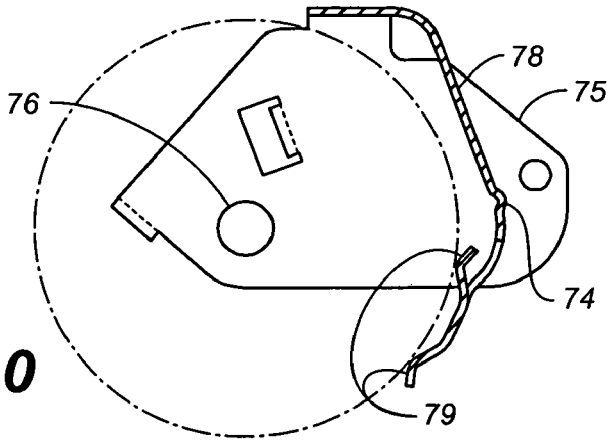
FIG. 10 is a cross-sectional thereof with the wheel of the caster wheel shown in dashed lines.

Referring to FIGS. 8-10, the brake assembly is comprised of a sheet-metal bracket 75 having parallel side walls 75*a* that fit within the frame 68 of the wheel caster 65. The bracket side walls 75*a* include aligned axial holes 76 that receive the caster's axel 66, and two sets of locking tabs 77 that engage with the edges of frame 68 to prevent the bracket 75 from rotating about the axel when installed. A foot actuatable ON-OFF pedal brake 85 is pivotably attached to the sheet-metal bracket 75 by means of a rivet 81 or other mechanical means. This pedal brake can suitably be fabricated of metal or molded plastic and includes a depressor cam 82 (see FIGS. 6 and 7), which pushes down on the depressible locking strip 78 of sheet-metal bracket 75 when the pedal is pivoted downward from the "Off" position shown in FIG. 6 to the "ON" position shown in FIG. 7. In the "OFF" position the locking strip 78 is in its relaxed position off of the caster wheel and the caster wheel is free to rotate. When rotated to the "ON" position, the depressor cam rides up over dimple 74 on the locking strip 78 and pushes the locking strip inwardly until the edges 79 of the cupped end of the strip contact the rolling surface of the caster wheel 69. The sheet metal bracket 75 is suitably fabricated of a spring tempered stainless steel capable of supplying a constant brake force against the caster wheel when the pedal 85 is in the rotated down "ON" position.

It is understood that other constructions of the brake assembly are possible. For example, the sheet-metal bracket 75 of the brake assembly could be incorporated into the metal frame 68 of the wheel caster as a one-piece assembly.

Figure 11:
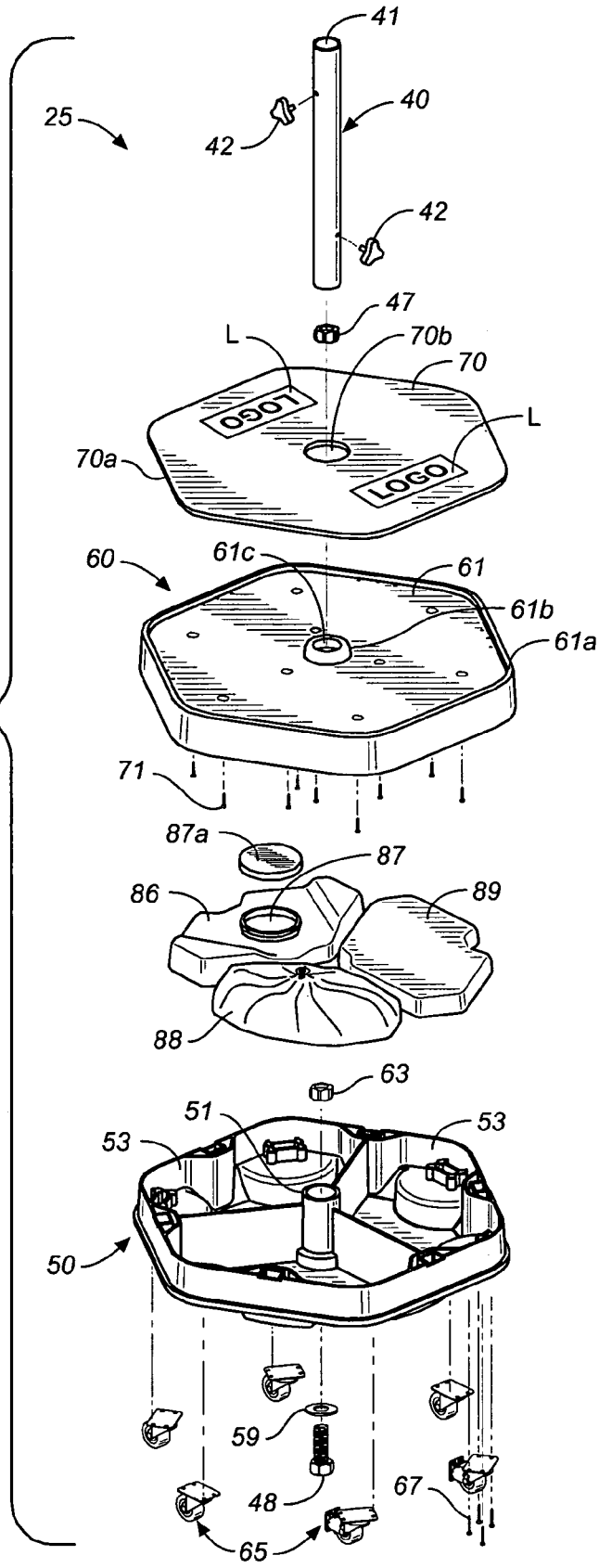
FIG. 11 is an exploded top perspective view thereof, showing insertable ballast forms and containers for adding ballast weight to the umbrella base.

As best seen in FIGS. 4, 5 and 11, the embodiment of the invention shown in FIGS. 1-11 further includes a removable billboard plate 70 having a top billboard surface 73 to which advertising indicia, such as company and other organization logos, trademarks or service marks L (collectively referred to herein as "company logos") are applied. The billboard plate has an outer perimeter edge 70*a* and center opening 70*b*, and is sized and shaped to fit onto the top wall 61 of the housing assembly's top cover portion 60 within the recessed area in the top wall defined by the top wall's raised perimeter rim 61*a* and raised central collar 61*b*. Preferably, the recessed area has a uniform depth and the billboard plate a corresponding uniform thickness so that the top of the billboard plate is substantially flush with the top of raised perimeter rim 61*a*. It is noted that in this embodiment the billboard plate is advantageously raised above the ground to enhance its visibility. In this raised position, company logos L or other advertising indicia applied to the billboard plate will be within normal viewing angles of persons standing or sitting near an umbrella held by the base, will less likely be scuffed or damaged, and will be less likely to be covered by foreign materials, such as by leaves or the like, which would obstruct the advertising message on the billboard plate. Also, by being removably attached to the housing assembly, the billboard plate 70 can be replaced by billboard plates with other advertising indicia such that the advertising messages used on the umbrella base can be readily changed.

The billboard plate 70 is mechanically attached to the top wall 61 of the housing assembly's top cover portion 60 by means of self-threading screws 71. Screws 71 are seen to screw into screw holes formed in bosses 72 formed on the underside of the billboard plate to fit into corresponding recesses 72*a* in the housing cover's top wall 61. While the billboard plate self aligns and is retained on the top wall 61 by means of the rim 61*a* and center collar 61*b*, mechanical attachment by screws 71 will prevent dislodgment of the billboard plate when the umbrella base is tipped or moved, and will deter theft of the logo bearing billboard plates. The billboard plate can alternatively be provided without a mechanical attachment or with other forms of attachment such as molded-in snap attachments.

It is seen that billboard plate 70 provides a readily visible top billboard surface 73 which surrounds the support pipe holding the umbrella shaft 31. Preferably, advertising indicia are applied to this top surface about the support pipe (such as shown by the two logos L. The advertising indicia can be located on and about, and cover any portion of the top billboard surface 73 to provide a desired advertising display, and can be applied or otherwise provided on this surface in any number of ways, including by silk-screening or painting the indicia directly on the top surface of the plate or by applying separate multi-colored labels or laminates bearing an advertising message. A suitable label having clear UV resistant lamination 90 can be permanently applied to the billboard plate as shown in FIG. 4 to protect the advertising message from scratching or deterioration. This process allows for up to four color processing that can match the necessary requirements of large organizations for using their licensed logos. Alternatively, the advertising indicia can be provided by molded-in raised or depress letters with texturing to give a three dimensional effect for eye-catching customer appeal, and could be illuminated by an internal light source within the umbrella base 25. This could be accomplished with fiber optics, light emitting diodes (LED), light emitted through the billboard plate 70 by a light source within the umbrella base 25, or by other means known in the art.

It shall be understood that the invention is not limited to an umbrella base having a removable billboard plate, and that the top cover portion of the housing assembly can have a billboard surface integral with the top wall of the cover portion. In this case advertising indicia such as company logos L would be applied or otherwise provided directly on the top wall 61 of the housing assembly's top cover portion 60.

As shown in FIGS. 4 and 11, support pipe 40, which as previously described holds and supports umbrella support shaft 31, is mechanically attached to the lower portion 50 of the housing assembly by means of a threaded nut 47 or equivalent threaded part mechanically attached to the inside bore 46 of the lower end of the support pipe. The nut 47 can be press fit, pinned, welded or permanently attached by other means know in the art. One advantage of using a stock hexagon nut 47 is cost while the other is that the points of the hex head can easily provide surface contact for press fitting or welding to the inside surface of bore 46. By using a hex headed part, openings between the hex points and the inside bore 46 of the support pipe 40 are advantageously created. These openings allow water that enters the top 41 of support pipe to drain around the nut 47 and down through drain openings 49 formed at the bottom of the central sleeve structure 51 of lower housing portion 50. By providing a route for water to escape, potential rust damage to the steel components can be prevented.

The bottom of the central sleeve structure 51 of the lower portion of the housing assembly is adapted to receive a cap screw assembly comprised of a standard threaded bolt or cap screw 48, washer 59 and threaded locking nut 63 as shown in FIGS. 4 and 5. Again, one advantage of this design is that off the shelf or standard components can be used that are economical yet made to very high tolerances. The threaded components of this assembly suitably have a robust one inch diameter by eight threads per inch and are constructed of zinc-plated or hot dipped galvanized steel for corrosion resistance. The locking nut 63 is installed into anti-rotate ribs 38 at the bottom of central sleeve structure 51, which center and prevent locking nut from rotating during installation of cap screw 48 through the sleeve structure's bottom opening 39. The ribs 38 also allow water or moisture to escape through the central sleeve structure as previously discussed. When assembled, the cap screw assembly firmly secures and stabilizes the support pipe 40, which becomes the support for the umbrella support shaft 31 and its umbrella shade 30.

FIG. 11 illustrates examples of self-contained ballasts that can be added to the ballast cavities of the lower portion 50 of the housing assembly, instead of the cavities being filled with a ballast material as earlier described. One example is a rigid fillable container 86 having a fill opening 87 and container lid 87*a* that fits within one of the ballast cavities. Such containers can suitably be blow molded from an inert plastic material such as HDPE for strength and economy, and can be filled with sand, gravel, water, or other suitable ballast material, depending on the desired ballast weight. Such a container would be provided for each of the ballast cavities in the housing; in this case three containers would be required. The rigid fillable containers are easily removed from the ballast cavities of the housing assembly to lighten the umbrella base. This is desirable if the base must be lifted and carried, such as when it is stored or relocated a substantial distance, for example from one commercial venue to another. Once removed from the umbrella base, the relative small size and lower individual weight of the ballast containers make them easy to stack, transport and store separate from the base.

Instead of using a rigid fillable ballast container, ballast can alternatively be provided in a non-rigid container, such as tie or zip bag 88. Such containers would normally be used with aggregate ballast materials only, but have the advantage of being inexpensive and easily stored and transported. Their shapes are also fluid, allowing them to easily conform to the configuration of the ballast cavities.

As a further alternative, ballast can be added to the ballast compartments 53 of the base by means of a fixed ballast form 93, which could be an enclosed rigid container pre-filled with a ballast material or liquid, or a pre-formed block of material of a predetermined weight, such as concrete, or a battery for the power console shown in FIGS. 27-33 as hereinafter described. Such ballast forms could also provide utilitarian components for the umbrella base such as one or more batteries to serve as a power source for umbrella lights or the like.

Figure 12:
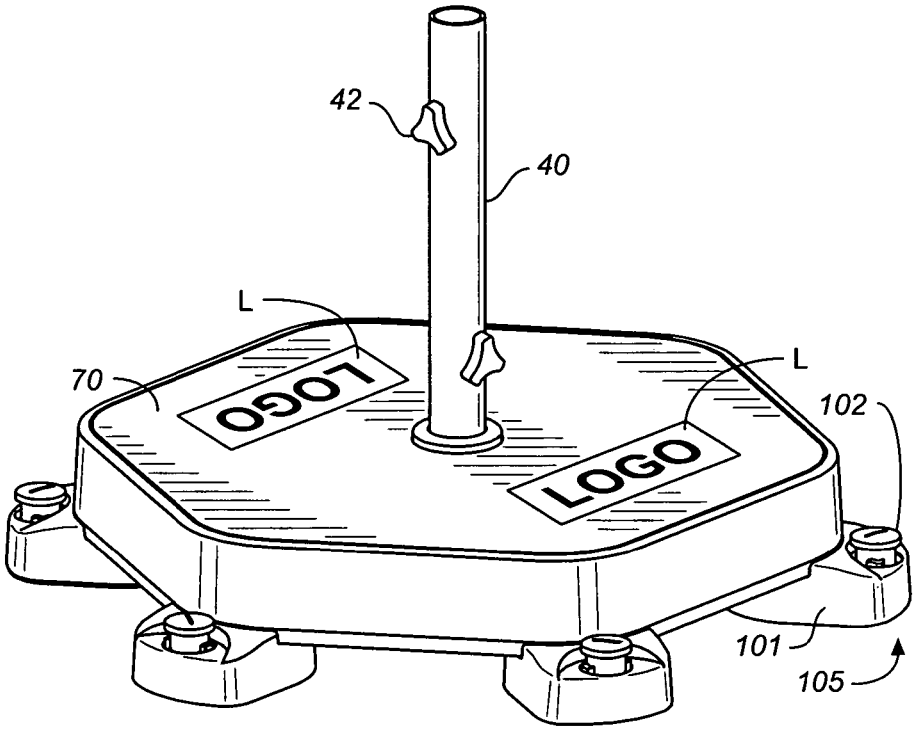
FIG. 12 is top perspective view of another embodiment of an umbrella base in accordance with the invention showing the use of support feet with wheel casters and showing the support feet in a retracted position to allow rolling of the base on the wheel casters.
Figure 13:
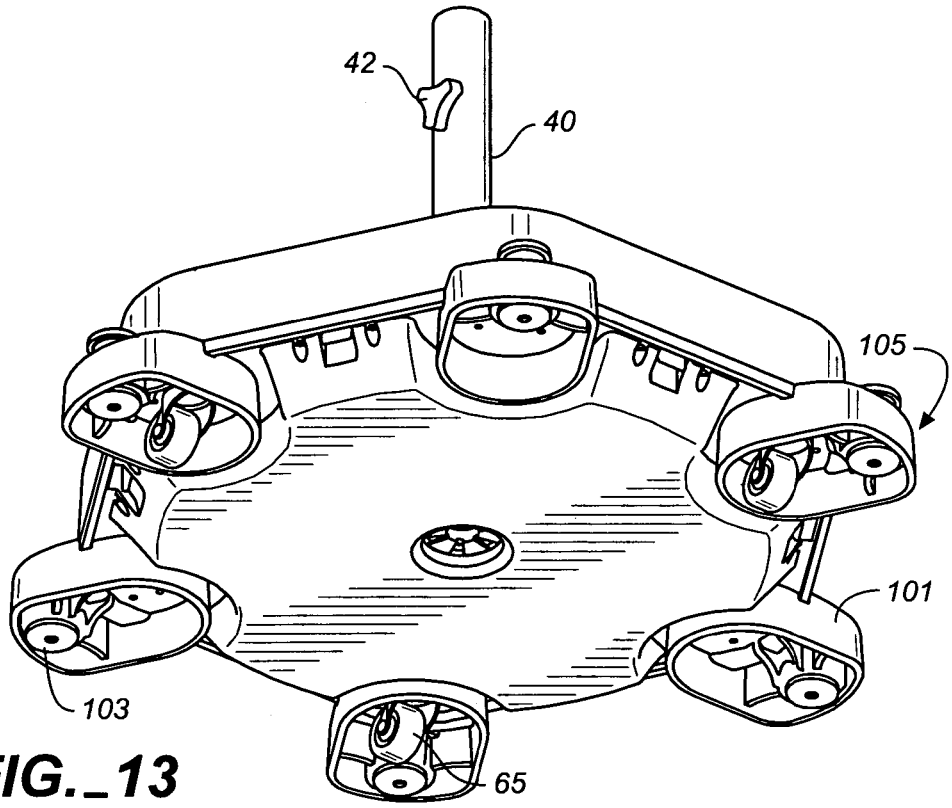
FIG. 13 is a bottom perspective view thereof.
Figure 14:
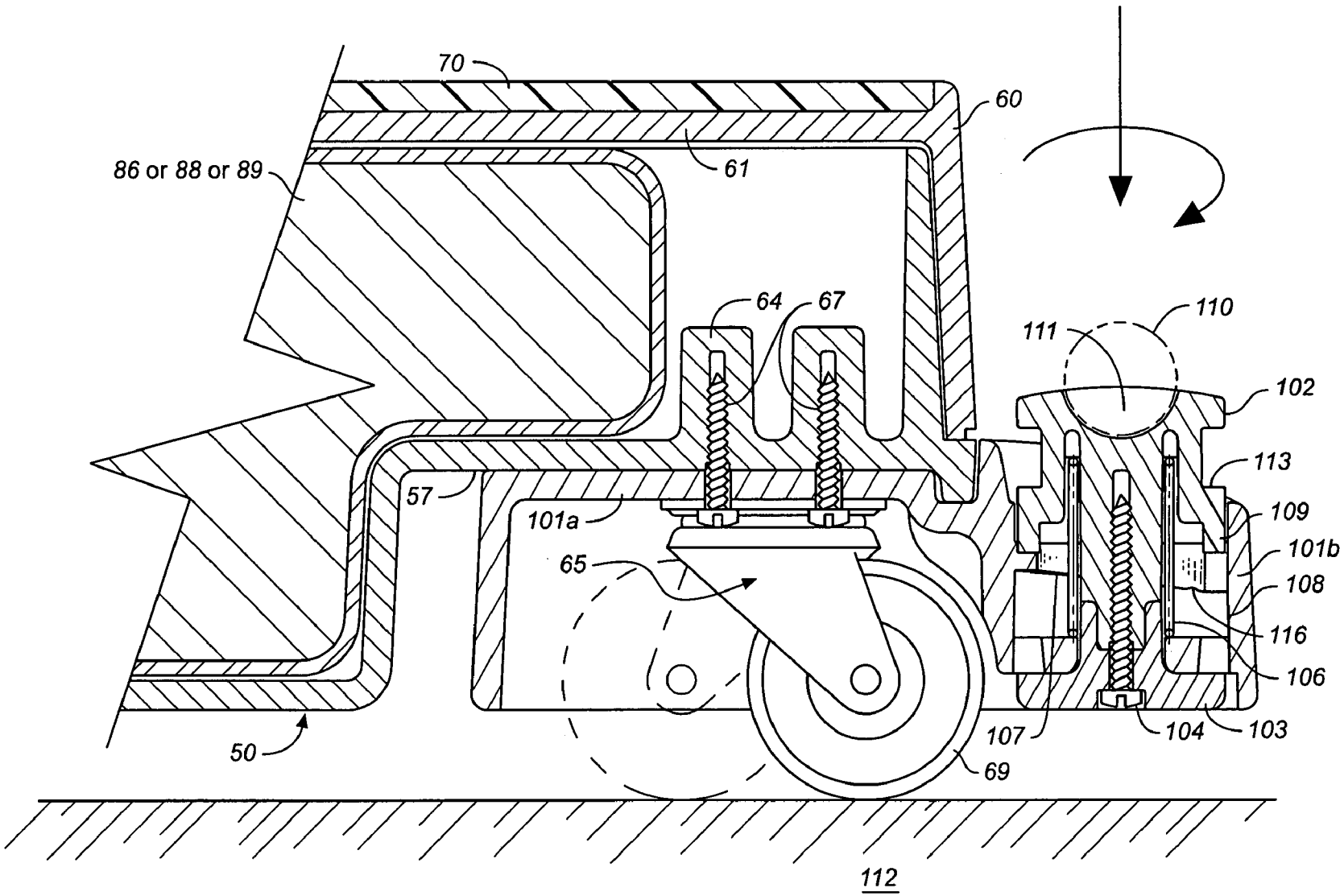
FIG. 14 is a fragmentary cross-sectional view thereof showing one of the wheel casters and retracted support feet in greater detail.
Figure 15:
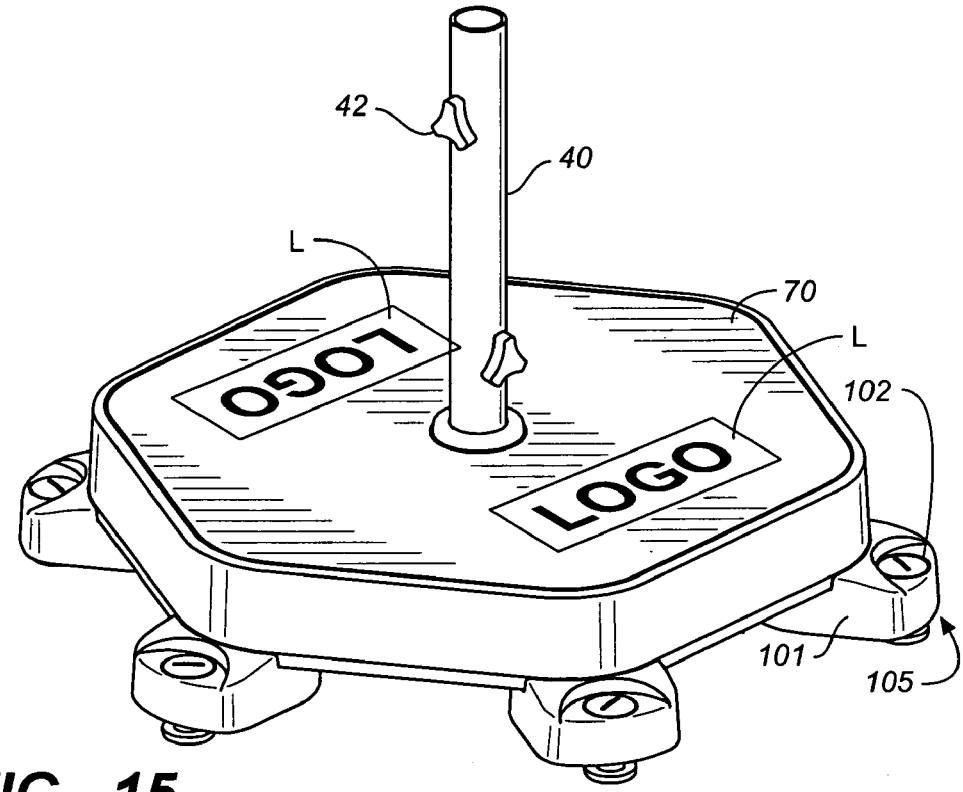
FIG. 15 is top perspective view thereof showing the support feet in extended position to prevent rolling of the base.
Figure 16:
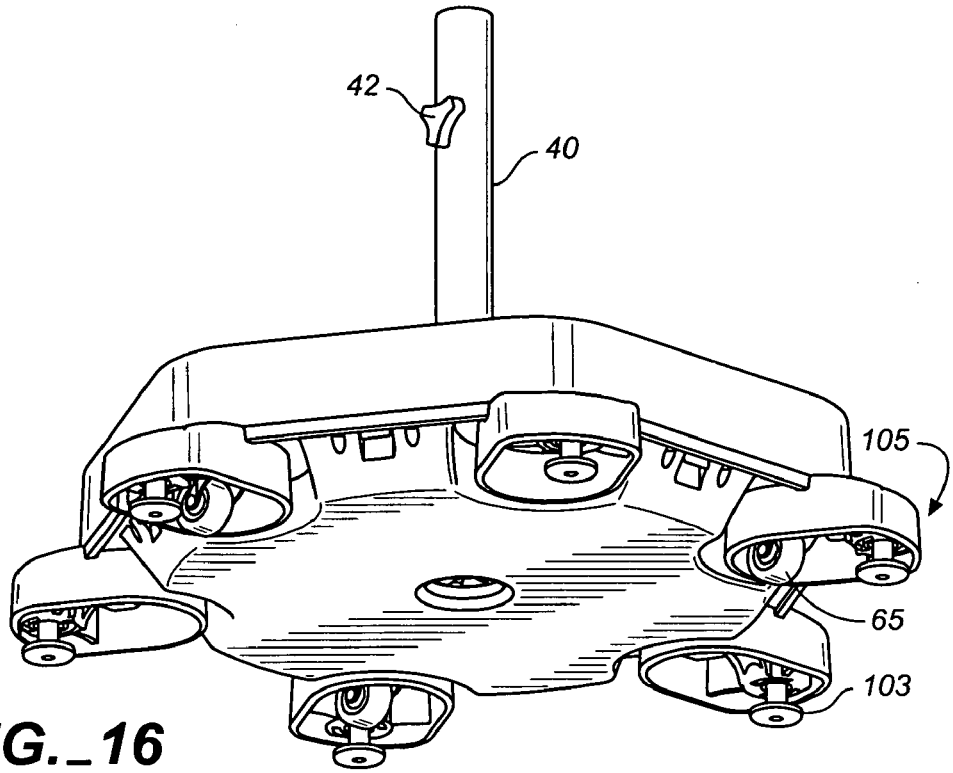
FIG. 16 is a bottom perspective view thereof.
Figure 17:
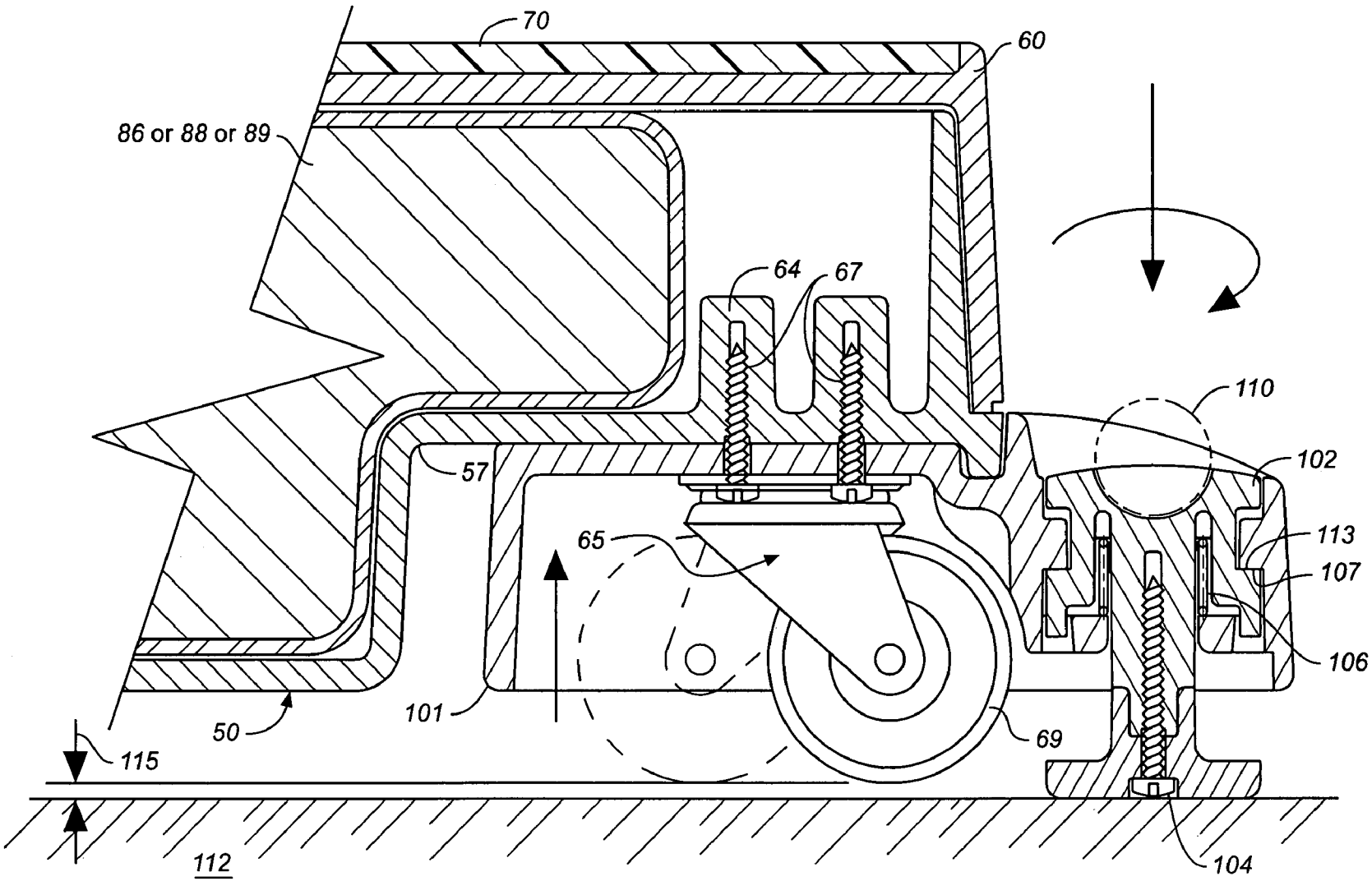
FIG. 17 is a fragmentary cross-sectional view thereof showing one of the casters and extended support feet in greater detail.
Figure 18:
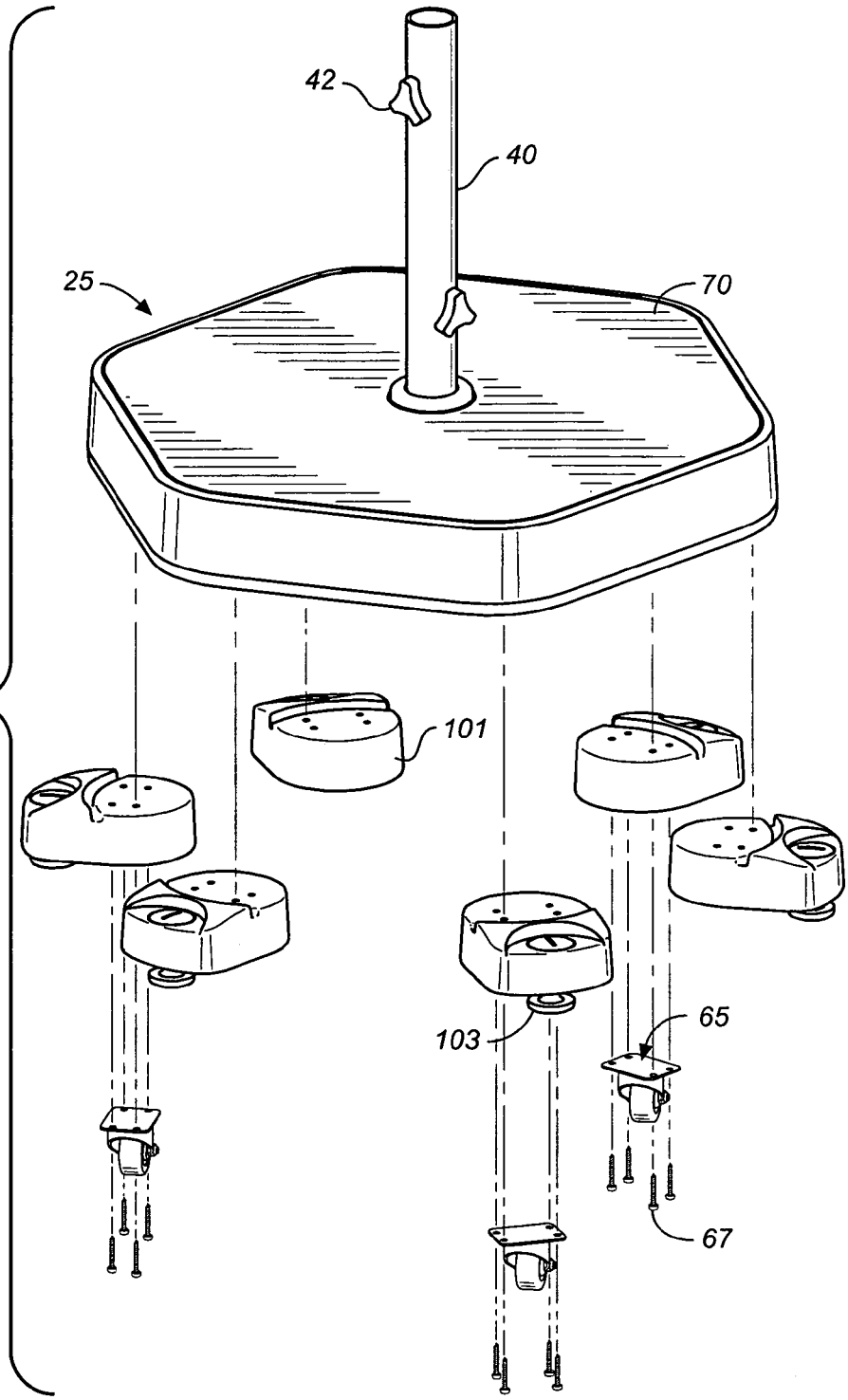
FIG. 18 is a an exploded view thereof.
Figure 19:
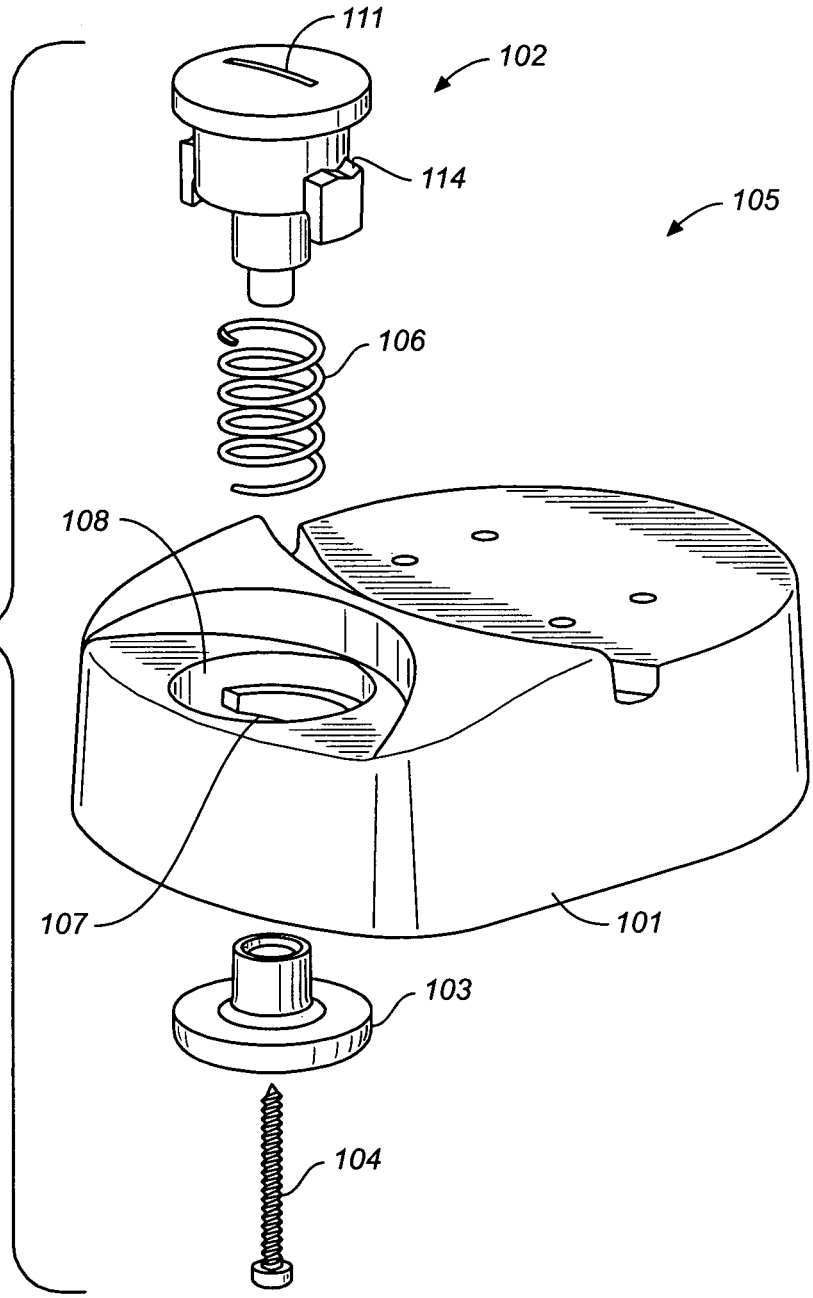
FIG. 19 is an exploded view of one of the support feet shown in FIGS. 12-18.
Figure 20:
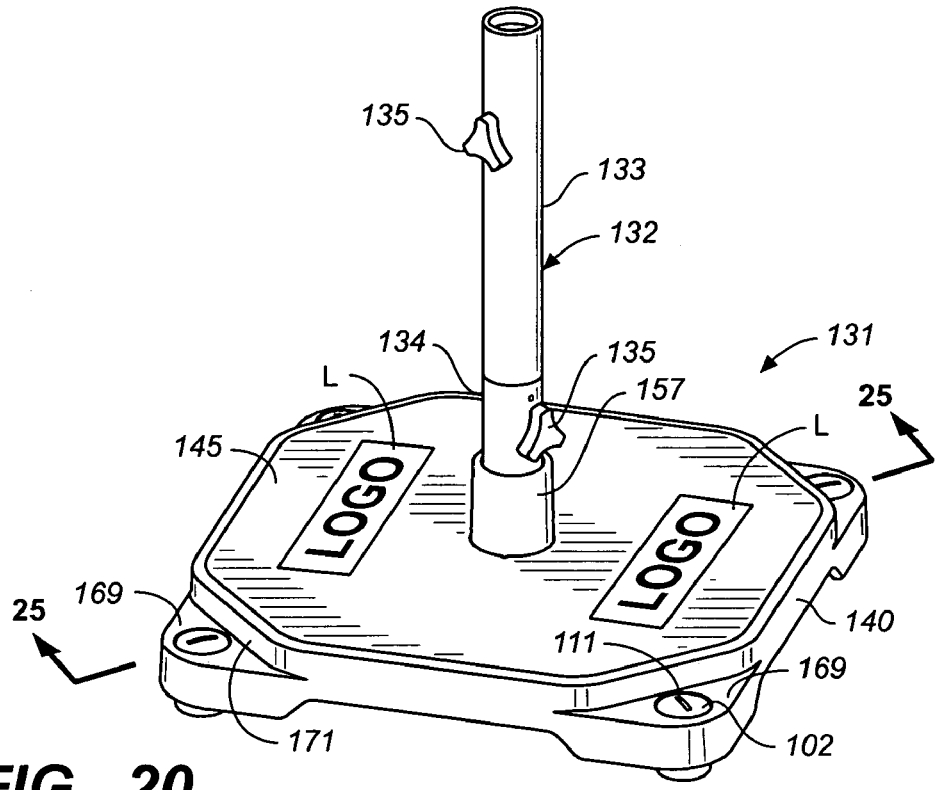
FIG. 20 is an top perspective view of yet another umbrella base in accordance with the invention.
Figure 21:
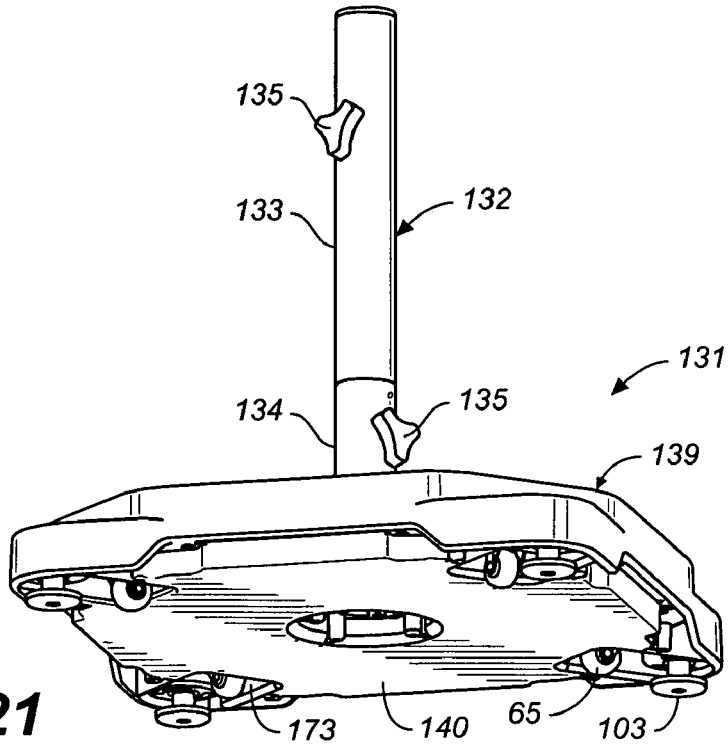
FIG. 21 is a bottom perspective view thereof.

FIGS. 12-19 depict an embodiment of the invention wherein the wheel caster locking mechanisms shown in FIGS. 8-10 are replaced with support foot assemblies 105 having cam-operated support feet 103 that deploy to stabilize the umbrella base 25 once its position has been set. FIGS. 12, 13 and 14 show the cam-operated feet in the up or non-deployed position. In this position the user can roll the umbrella base on the wheel casters 65 as in the previously described embodiment. FIGS. 15-17 show the feet in their deployed position, where the umbrella base is raised up on the feet so that it can no longer roll. It is seen that the deployed feet contact the ground beyond the perimeter of the housing assembly for enhanced stability. FIGS. 14, 17, 18 and 19 show in greater detail the construction of the support foot assemblies and how they attach to the umbrella base.

More specifically, each support foot assembly includes a frame structure 101, suitably fabricated of HDPE or polypropylene plastic, having an inner part 101*a* and outer part 101*b*. As shown for example in FIG. 14, the inner part 101*a* of the frame structure of each support foot assembly is secured by wheel caster 65 and wheel caster screws 67 into one of the bottom wall recesses 57 in the lower portion of the housing assembly. The outer part of the frame structure extends beyond the perimeter of the housing assembly and carries a cam-screw 102 in a cam-screw opening 108. Cam tabs 109 are provided on the perimeter of the cam-screw for engaging internal cam surface 107 in the cam-screw opening as hereinafter described. A support foot 103, which contacts the ground when deployed, is attached to the bottom of the cam-screw by a self-threading screw 104. Both the cam-screw and support foot are preferably fabricated of a strong and durable material such as a glass filled nylon or polyester base resin, and as shown in FIG. 14 are spring biased in the up position by coil spring 106, which is preferably constructed from corrosion resistant stainless steel.

Once a location has been set and the user wishes to stabilize the umbrella base 25, he or she does so by inserting a coin, such as a quarter 110 or a special tool into the slot 111 formed in the top of cam-screw 102, and pushing down and rotating the cam-screw clockwise, as depicted by the arrows in FIGS. 14 and 17. Such a downward and clockwise turning motion will engage the top surface of cam follower 113 into and under the cam surface 107 formed in cam-screw opening 108. As the user continues rotation of the cam-screw 102, the foot 103 contacts the pavement 112. Upon contact, the top of the cam follower 113 of the cam tab 109 pushes upward on the underside of cam surface 107, raising the caster wheel 69 off pavement 112 as shown by arrows 115 in FIG. 17. Once the correct height 115 has been reached, the cam detent 114 on the cam follower 113 (see FIG. 19) mates with a detent 116 formed in the cam surface 107 to mechanically lock these parts together so as to prevent further rotation. The foregoing procedure is repeated for each of the support foot assemblies 105, and as the user does so, the wheel casters of the umbrella base 25 will be lifted off the ground 112, transferring the weight of the base to the support feet 103. At such time the user wishes to unlock the feet 105, he or she can insert a quarter 110 or special tool into slot 111 and by turning the cam-screw 102 counter-clockwise to override the detent and raise the support foot to the unlock position as shown in FIGS. 12, 13 and 14.

It is contemplated that the umbrella base 25 shown in FIGS. 1-19 can be shipped assembled, partially assembled, or unassembled. Preferably, it comes unassembled, and with the support pipe, billboard plate and caster wheels removed. The ballast material for the housing assembly can be shipped separately or purchased by the user according to the user's needs.

To assemble the umbrella base, the billboard plate 70, if not preinstalled, is first placed on top of the housing cover 60 and screws 71 inserted as shown in FIG. 11 to secure the billboard plate. When placing the billboard plate onto the housing cover, the screw bosses 72 on the bottom of the plate must be placed in the corresponding holes in the housing cover. The wheel casters 65 are then attached to the bottom of the lower housing in perimeter recesses 57 by means of screws 67, after which the support pipe 40 is installed. The support pipe is installed by first placing lock nut 63 into the housing's central sleeve structure 51 and then inserting the cap screw 48, on which washer 59 has been placed, into the bottom opening 39 of the central sleeve structure, and threading it through the lock nut. The lower end of the support pipe with its embedded nut 47 is then inserted into the sleeve 51 and screwed onto the end of the cap screw which projects through lock nut 63. With the lower housing and support pipe in their upright position, the ballast cavities are filled with a selected ballast material. (If filled ballast containers or fixed form ballasts such as shown in FIG. 11 are used, they are simply placed in the ballast cavities.) To prevent the ballast material from entering the snap latch channels 32*a* and other surrounding openings not part of the ballast cavities, these openings can be covered during the ballast fill. Removable adhesive protective coverings that fit over these openings can suitably be provided for this purpose. Once the ballast cavities are filled and the above-mentioned protective coverings removed, the housing cover and billboard plate are placed over the top support pipe and lower housing so that the support pipe 40 (with thumb locking screw 42 removed) slides through the center openings 61*c*, 70*b* in the housing cover and billboard plate, and so that the outer sidewalls 62 of the housing cover slides over the sidewalls 52 of the lower housing while the snap latches 32 slide into latch channels 32*a*. The top cover is pushed down until the snap latches lock, and the unit is then tipped up to install screws 43. Finally, the thumb screws are replaced on the support pipe, which is now ready to receive the shaft of an umbrella. It will be understood that screws 43 are optional and are not required to secure the housing cover to the lower housing.

To change an advertising message, the billboard plate 70 can be exchanged with another billboard plate. This is accomplished by removing the top cover of the housing assembly and then removing screws 71, which hold the billboard plate to the top cover of the housing assembly. A new billboard plate is then screwed onto the top cover and top cover reinstalled as above-described. It will be understood that alternative constructions of the umbrella base are possible that provide for other assembly steps or the elimination of steps. For example, the billboard plate could be provided without screw attachments and possibly in two halves or in more segments to allow the billboard plate to be removed without any disassembly of the housing.

FIGS. 20-26 show a variation of the embodiment of the umbrella illustrated in FIGS. 12-19. In this variation, the umbrella base 131 has a generally square shape with four wheel casters 65*a* and four support foot assemblies 105*a* located at the four corners of the housing. The support foot assemblies in this embodiment are essentially identical to the support foot assemblies 105 shown in FIGS. 12-19, except that here the frame structure for the assemblies are integral with the lower portion of the housing. Other alternative structures are included in this embodiment. One is the addition of structure that allows ballast cavities in the housing assembly to be filled without removing the top portion of the housing. Another is found in the construction of the support pipe. And yet another involves an internal construction of the housing assembly which prevents moisture from reaching the ballast fill in the ballast cavities.

In this embodiment, the support pipe 132 is split into two sections, namely, top section 133 and bottom section 134, having joinable ends 133*a* and 134*a*, with rivet holes 163*a* and 163*b*, which align when the ends are joined and which receive a plastic rivet or the like (not shown) for holding the joined ends together. Each of these sections has a thumb screw 135. The split support pipe further includes a threaded nut 136 that projects from the pipe's bottom end 137 so as to eliminate the need for a separate locking nut. Using this embodiment, installation of the support pipe is simplified as hereinafter described. Also, the split pipe advantageously allows the umbrella base to be used under tables that will not accommodate a long support pipe, and where the extra length of the support pipe is not needed. In these situations the top section of the support pipe is simply removed.

The body portion of this embodiment is similar to the previous embodiment. More specifically, a body portion in the form of housing assembly 139 has a lower ballast holding portion 140, and a top cover portion in the form of a cover plate 141 secured to the lower portion of the assembly by means of top screws 143. Advertising indicia, such as a company logo L, are provided on a separate billboard plate 145 having screw bosses 146 that fit into screw boss holes 176 in the cover plate 145, which is attached by screws 180. The lower portion of the housing assembly has outer perimeter sidewalls 147 and an inner wall structure 149 inside of the outer perimeter sidewalls. The inner wall structure 149 supports the cover plate 141 and the billboard plate 145 within the outer perimeter walls of the lower housing portion, and creates an interior compartment which is divided into four equal sized ballast cavities 151 by partition walls 153. The partition walls terminate at an center ring wall 155, which surrounds a central cylindrical retaining sleeve structure 157 that holds the split support pipe 132. Sleeve structure 157 having anti-rotating ribs 158 (seen in FIG. 24) holds the support pipe in substantially the same fashion as described in the earlier embodiments. However, in this case installation of the support pipe is simplified because the cap screw 48 can be screwed directly into the pipe's projecting nut 136 after the bottom end of the support pipe is placed into the sleeve structure. The support pipe is prevented from rotating because the projecting nut engages in the anti-rotating ribs 158 when the pipe bottoms out in the sleeve structure. Also, mating detent element 142*a*, 142*b* prevent the top section of the split pipe from rotating in the bottom section.

Figures 25, 25A:
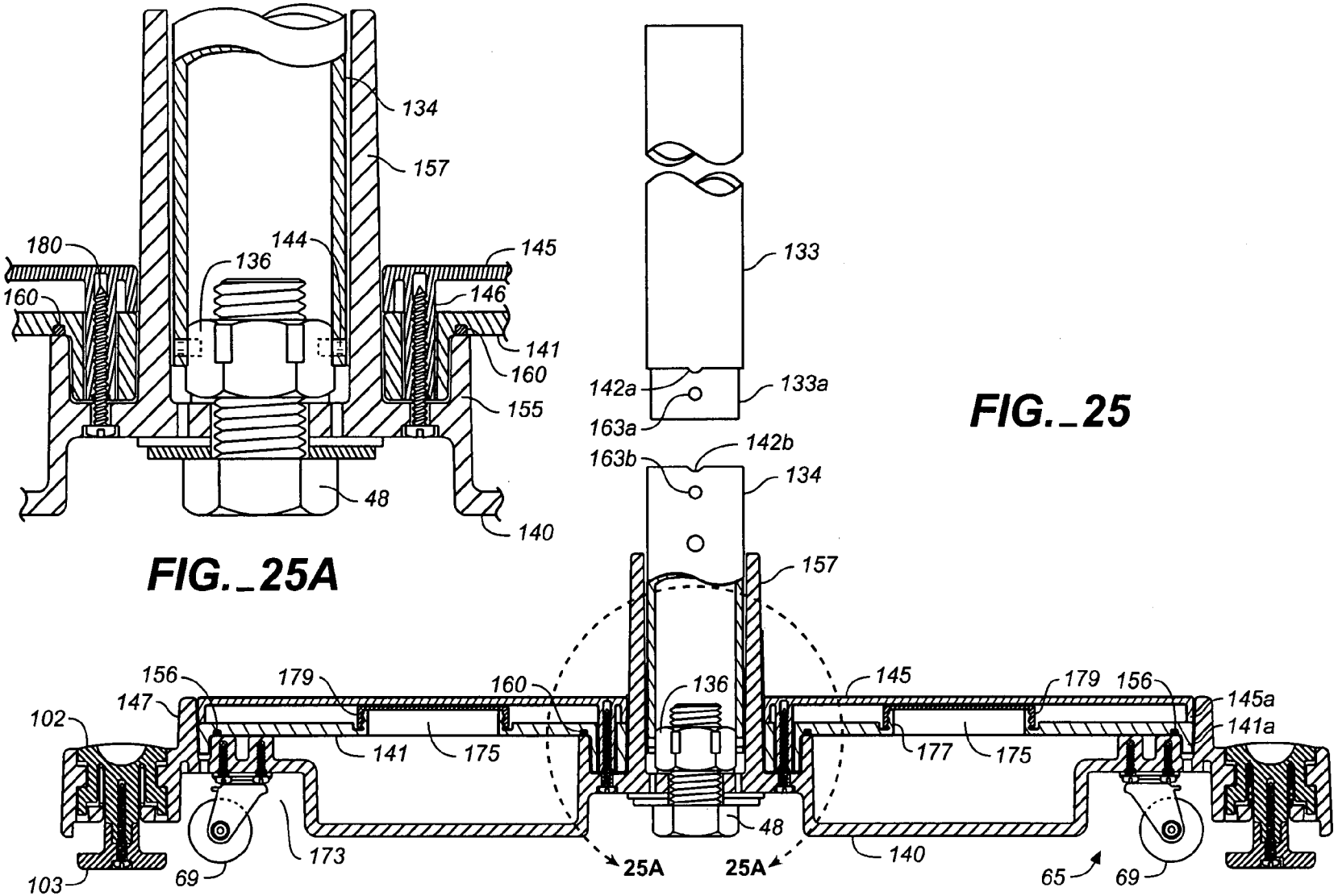
FIG. 25 is a cross-sectional view of the umbrella base taken along lines 25-25 in FIG. 20, with the top section of the split umbrella shaft support pipe separated from the lower section.
FIG. 25*a* is a fragmentary view thereof taken along lines 25A-25A in FIG. 25.

It is noted that both cover plate 141 and billboard plate 145 of the housing assembly have turned-down perimeter edges 141*a* and 145*a*. In the case of the cover plate, these edges fit over the lower housing's inner wall structure as shown in FIG. 25 when the cover plate is placed on the lower housing. In the case of the billboard plate, the turned-down edges rest on the cover plate and raise the billboard surface up so that it is substantially flush with the top of the lower housing's outer perimeter sidewalls 147; they also produce a space under the cover plate to accommodate a fill opening structure as hereinafter described.

The inner wall structure and center ring wall of the lower housing of this embodiment effectively isolate the ballast compartments from the joints that occur between top cover plate and lower housing's perimeter sidewalls 147, and between the sleeve 157 and the center openings 152, 154 of the cover plate and billboard plate. It is at these joints that entry of moisture into the housing assembly is most likely to occur. The inner wall structure 149 creates a perimeter buffer space 159, and inner ring wall 155 creates interior buffer space 161. Drain holes, such as drain holes 165 and 167, are provided at the bottom of both of these buffer spaces to allow moisture collected in these spaces to drain from the housing assembly. Also, outside and inside O-rings 156, 160 can be provided on the underside of the housing cover in order to hermetically seal the ballast cavities. Sealing of these two parts can be accomplished in any number of ways known in the art, including using sealing compounds.

Figure 22:
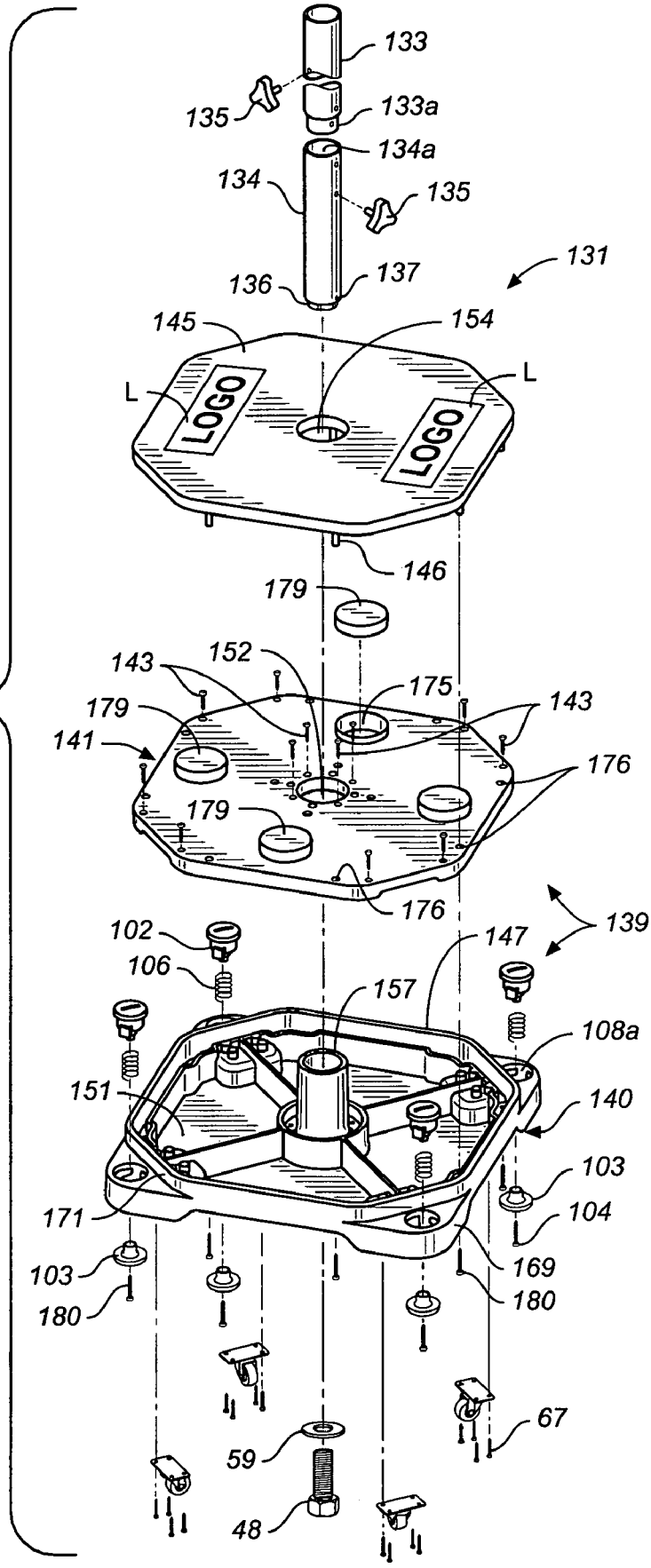
FIG. 22 is an exploded top perspective view thereof.
Figure 23:
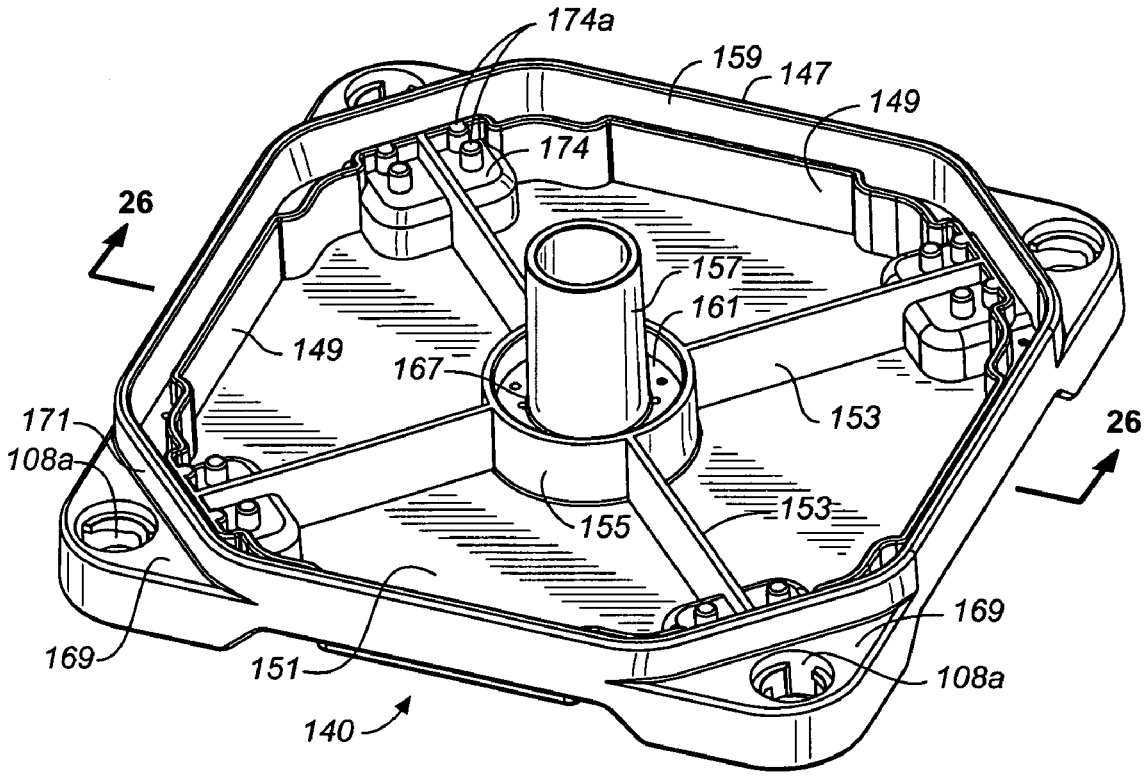
FIG. 23 is a top perspective view of the lower portion of the housing assembly of the umbrella base shown in FIGS. 20-22.
Figure 24:
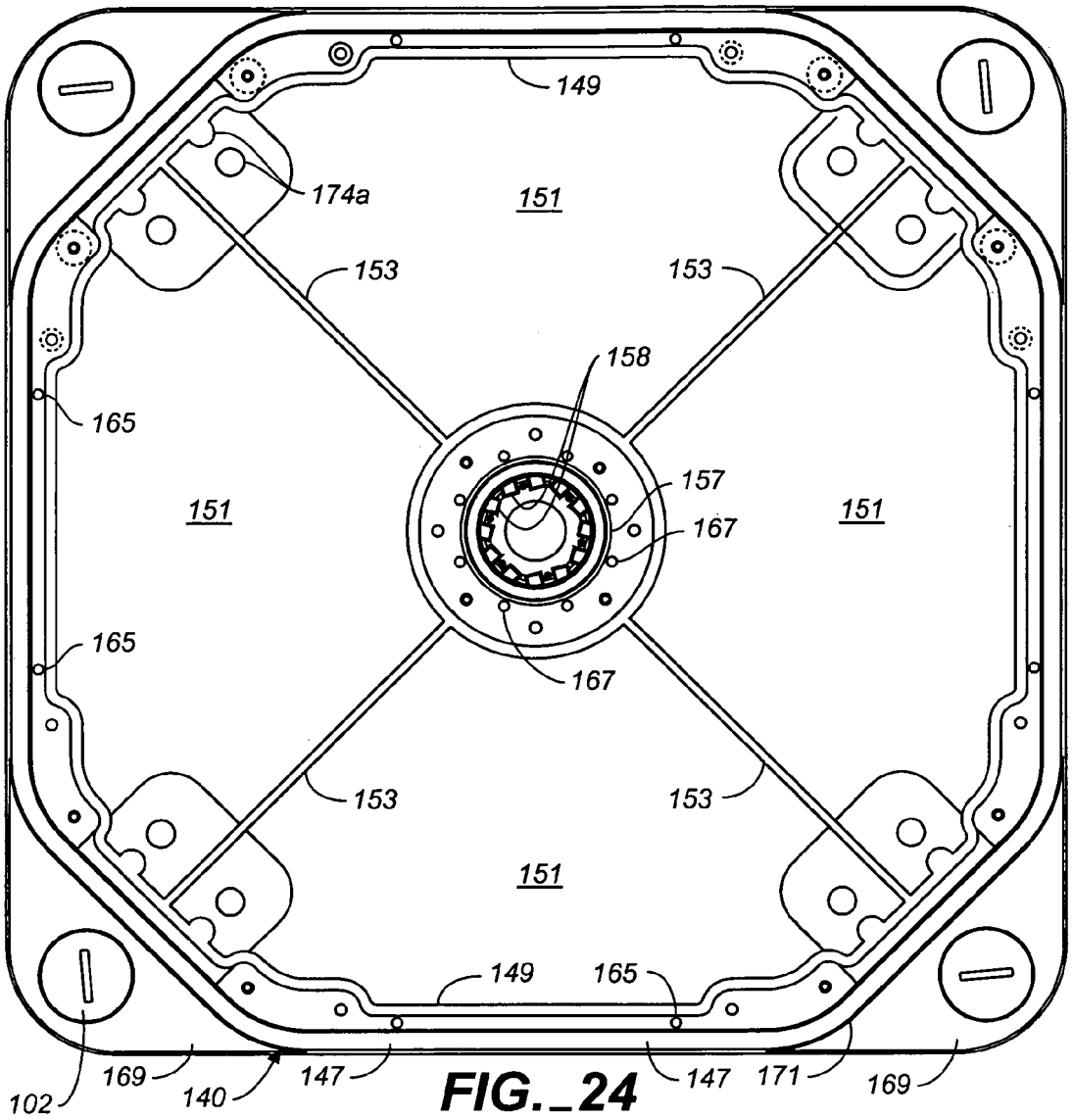
FIG. 24 is a top plan view of the lower portion of the housing assembly.
Figure 26:
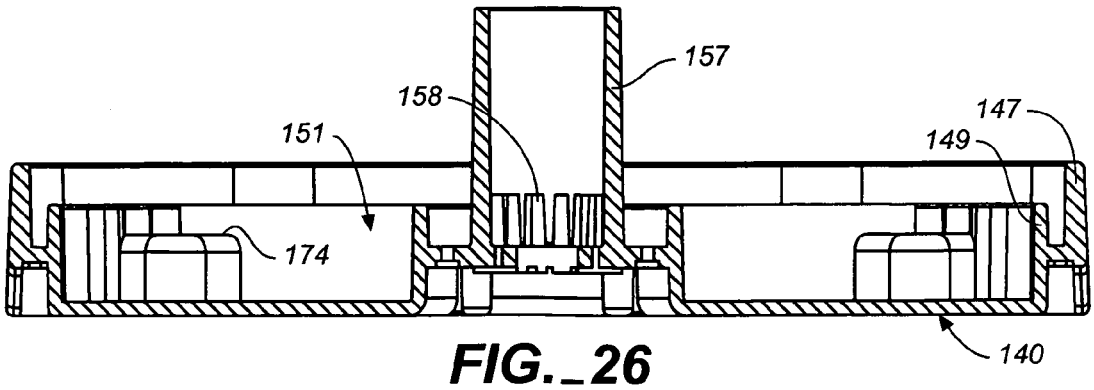
FIG. 26 is a cross-sectional view of the lower housing taken along lines 26-26 in FIG. 23.

The corners of the lower housing are seen to have shoulder structures 169 that extend from angled corner portions 171 of the perimeter sidewalls. Each of the shoulder structures have a cam-screw opening 108*a* for receiving cam-screws 102, to which the support feet 103 are attached. The cam screws 102, support feet 103 and associated springs 106 of the support foot assemblies in this embodiment are identical to the cam screws, support feet and springs of the support foot assemblies in the embodiment shown in FIGS. 12-19. Also, the support feet are deployed in the same manner as previously described to take the weight off of the wheel casters 65, which, as best shown in FIG. 22, are attached by screws 67 into corner recesses 173 formed in the underside of the lower housing behind the support foot assemblies. These corner recess have back walls 174, and screw bosses 174*a* on the top side of the back wall to receive the caster screws 67.

To allow the ballast cavities 151 to be filled without removing cover plate 141, a ballast fill opening 175 is provided in the top cover plate of the housing above each of the ballast cavities. These openings each have an upwardly projecting collar 177 with and external thread and an associated internally threaded lid 179, which screws onto the collar. Thus, it is seen that ballast cavities can be filled by simply removing the billboard plate 145 and unscrewing lids 179. The billboard plate is secured to the top cover plate by screws 180, so removing the billboard plate will first require the removal of these screws, which insert from the bottom of the lower housing through screw openings 176 in the cover plate into screw bosses 146 on the bottom of the billboard plate.

As in the previous embodiments the top cover and bottom portions of the housing assembly, along with the billboard plate 145 and fill opening lids 179, can be suitably be fabricated as injection or structural foam molded polymer (e.g. HDPE or polypropylene) parts having high UV resistance.

Figure 27:
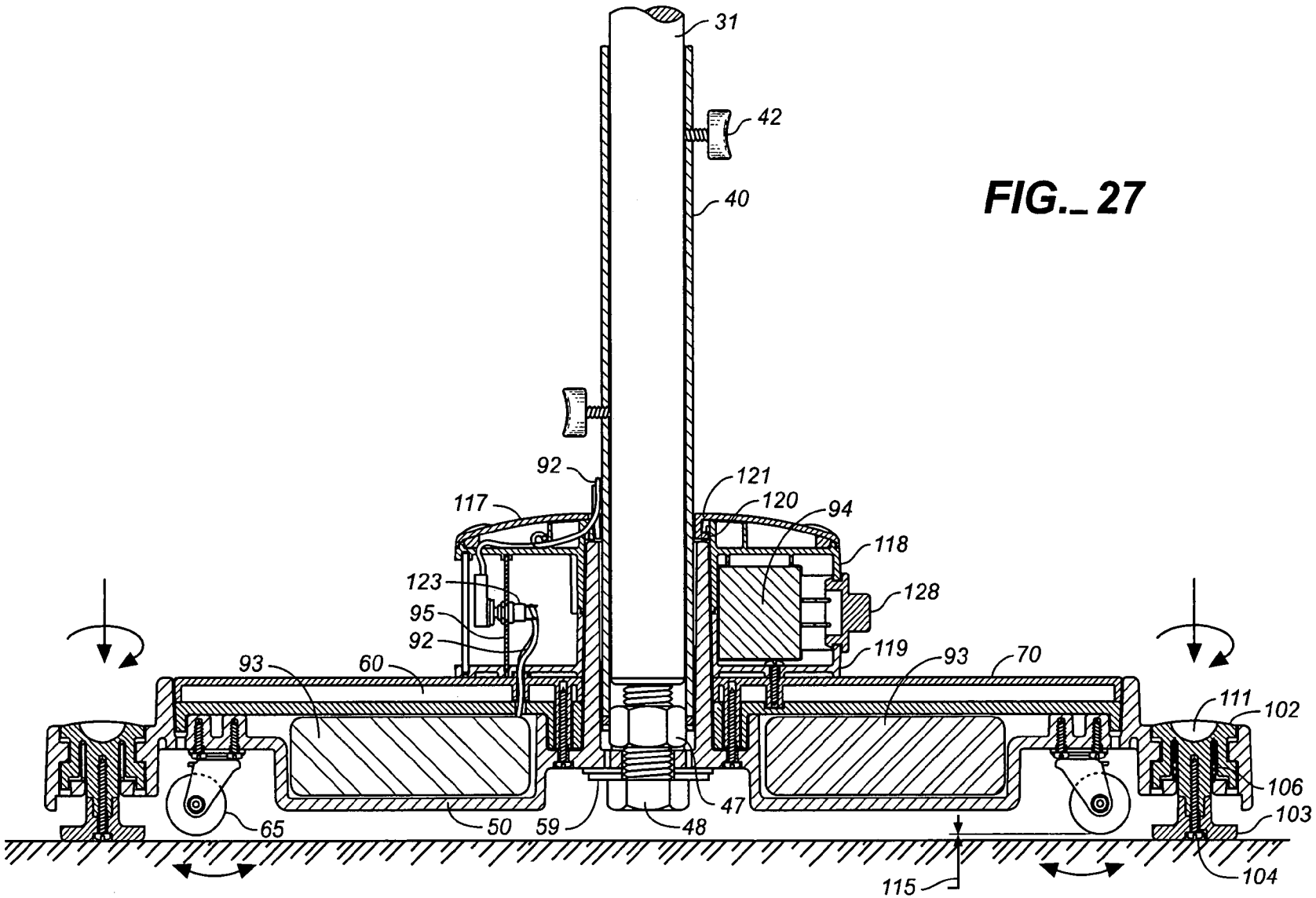
FIG. 27 is the cross-sectional view of the umbrella base as shown in FIG. 25, with the addition of a batteries to the ballast cavities and a power console to the top of the umbrella base.

FIGS. 27-35 show yet another aspect of the invention wherein a power source is provided in the umbrella base of the invention and a power console is provided for a convenient and easily accessed electrical connection to the power supply by persons using the umbrella. FIG. 27 shows the embodiment of the umbrella base shown in FIGS. 20-26, with a power source in the form of batteries 93 (or other power sources such as power cells) placed in the ballast cavities of the lower ballast housing 50. A power console 84 on top of the umbrella base has a control panel 95 that can be used to connect the power source 93 in the base to electrical devices such as lighted advertising, fiber optics, solar cells, fans, stereos, heaters and other items that compliment an outdoor environment. These devices can be connected to the control panel 95 and power source 93 by an electric path such as wires 92 that can preferably be hidden by running the wires 92 up through the inside bore of the umbrella support shaft 31. It is also understood these wires 92 can also be wrapped as shown along side umbrella support shaft 31, if desired. This power source and its devices can be controlled manually by the control panel 95, by timers built within the console 84 or by a separate remote control (not shown) providing the user the ability to control his or her outdoor environment with the touch of a button.

As shown in FIG. 30 through FIG. 33, the power console 84 with the control panel 95 includes one or more ON/Off switches 96 that can be used to control lighted advertising logos (such as the above-described logos L on the billboard surface of umbrella base 25), fans, music, fiber optics, lights etc. Control panels 95 may also include a 12 volt receptacle 97 such as used in automobiles, boat or recreational vehicles which can be used to power a laptop computer, cell phone, blender, small refrigerator or other 12 volt devices or appliances.

With the development of wireless communication more and more people are extending their working environment outdoors. One major problem exists that many devices such as laptop computers are a power drain on there internal batteries. One reason is the manufacturer is always trying to make the portable devices or computers as small and as lightweight as possible thus the size of the battery is very important to the total weight of the product. However, in the present invention, the user can use his or her standard car 12 volt attachment to connect to the powerful independent power source 93 within the umbrella base 25 by means of receptacle 97. The umbrella shade 30 now provides the shaded environment for the user, while the base 25 supplies the power for hours to computer or other battery related products without the worry of the batteries going dead. It is also understood that the base 25 can also be used to recharge those battery related devices providing another service that is not enjoyed by prior art umbrella base configurations.

In addition, a battery charge indicator 98 can also be provided in the console. This meter or LED indicator would notify the user by means of a charge indication when the power source or batteries 93 would need to be recharged. The batteries 93 can be very large and of considerable weight providing ballast in the ballast cavities of the umbrella base that can outweigh a standard car battery in some cases.

Figure 28:
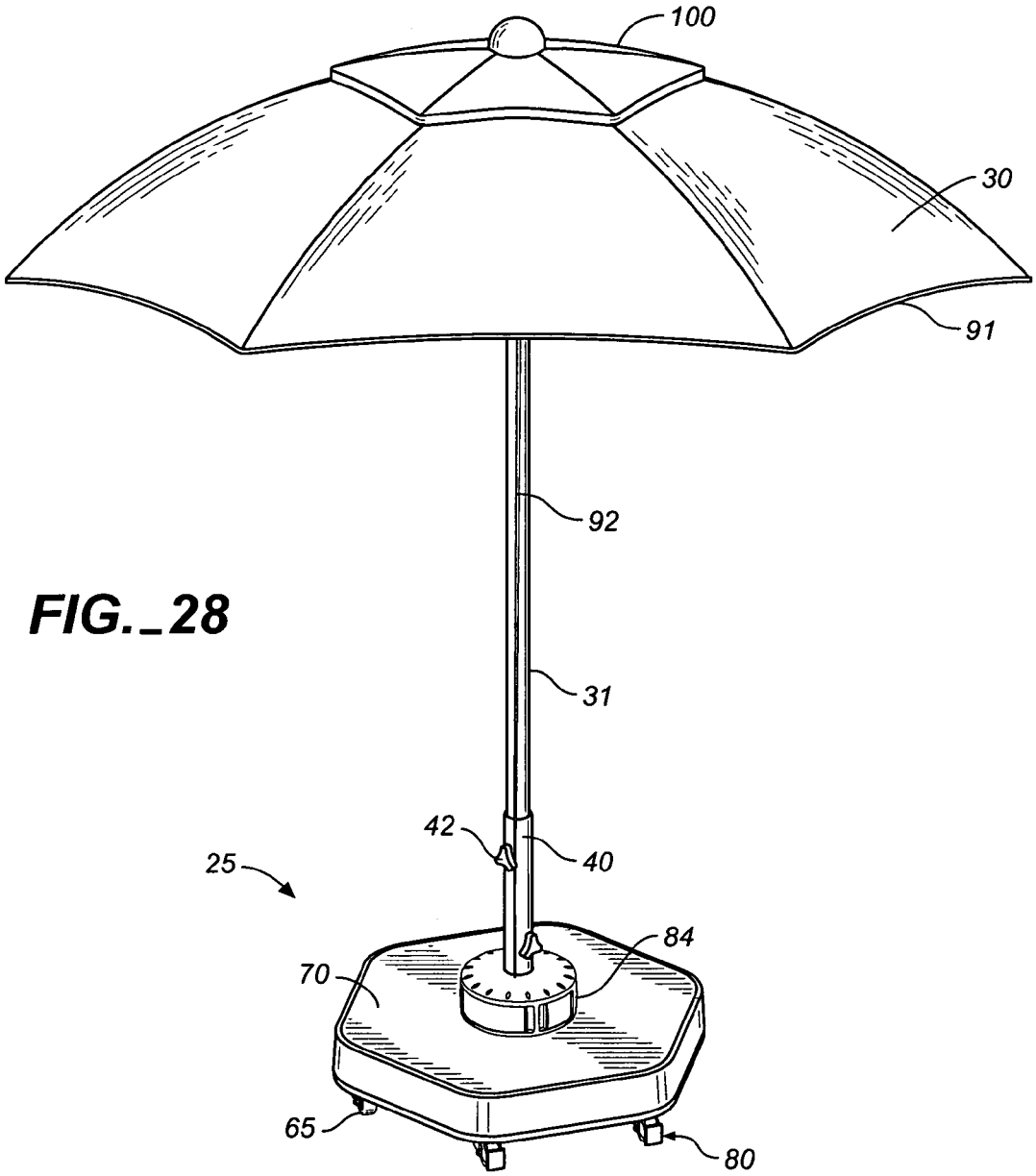
FIG. 28 is a top perspective view of an umbrella base holding an umbrella and having a power console on the umbrella base.
Figure 29:
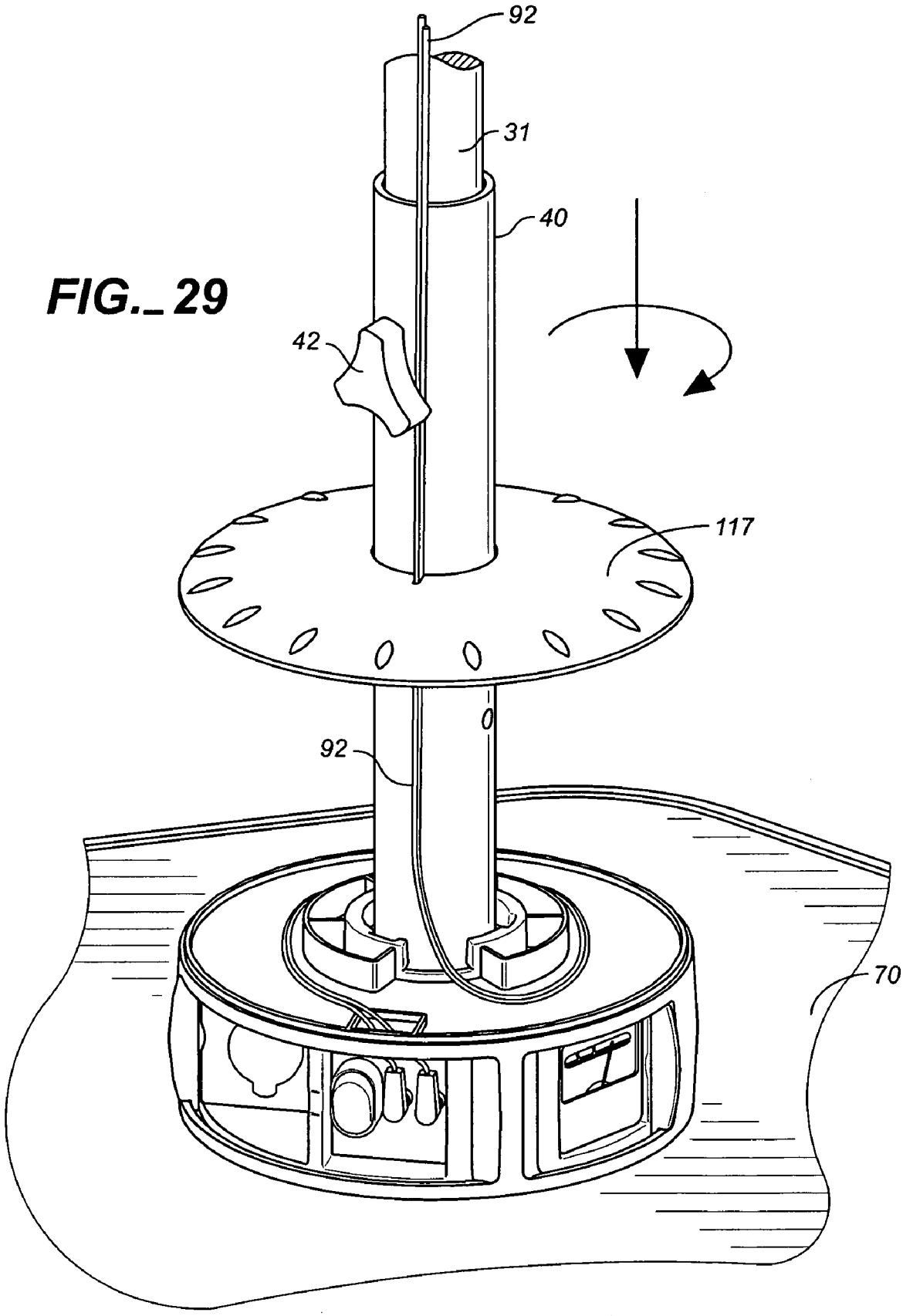
FIG. 29 is an fragmentary top perspective view thereof showing the top of the power console lifted off of the power console housing.

The rolling capability of the embodiment of the umbrella base shown in FIGS. 27 and 28 will facilitate movement of the base with heavy internal batteries. In this case, the user could easily roll the umbrella base 25 to a safe location, which can supply 120 volts for recharging the batteries 93 through the 110 volt transformer 94 found in console 84. It is also understood that the batteries can be charged with a transformer that can be plugged into a wall outlet with a matting receptacle (not shown) being mounted to the console 84 for connection. Once the umbrella base has reached its full charge as shown by the charge indicator 98, the user would then disconnect the recharging source, then easily move the fully charged umbrella base 25 to its new location. It is also understood that this transformer/receptacle 94 can also be part of an inverter that could convert the 12 volt D/C power source into 120 volt power supply for operating 120 volt devices if so desired. (It is understood that an inverter could also be located in one of the ballast cavities of the umbrella base.) Depending on the power necessary to supply the electrical component such a laptop or umbrella lights 91, the power source can easily run these items for many hours without the need for recharging.

In the case where the user may find this cumbersome or does not want to periodically recharge the umbrella base 25, one or more optional solar panels 100 can be provided on the umbrella as shown in FIG. 28, and used to charge the power source 93 during daytime hours. The solar panels 100 could be sewn into the fabric of umbrella shade 30 or could be configured to be a separate part that would accessorize the top of the umbrella shade 30. In any case, this could be important for those applications that are a considerable distance from a 120 volt power source or that would be difficult to roll the umbrella base 25 to a recharging station. This option would also be very important to hotel, restaurant or resorts that have many umbrellas and do not wish to be concerned with the periodic charging maintenance necessary in the prior embodiment. As an alternative to the solar panels 100, some applications such as near the ocean or in windy areas could provide a wind source that can also be used to turn an optional wind turbine (not shown) that would be mounted to the top of the umbrella shade 30. This small wind turbine can be used to create electrical energy to recharge our power source 93 and thus provide a source of renewable power. Applications such as these could also allow the umbrella base to be modified to remove the caster wheels 65 and locking wheel 80 and provide for permanently mounting umbrella base 25 in a fixed position or non-moveable location (not shown).

Figure 33:
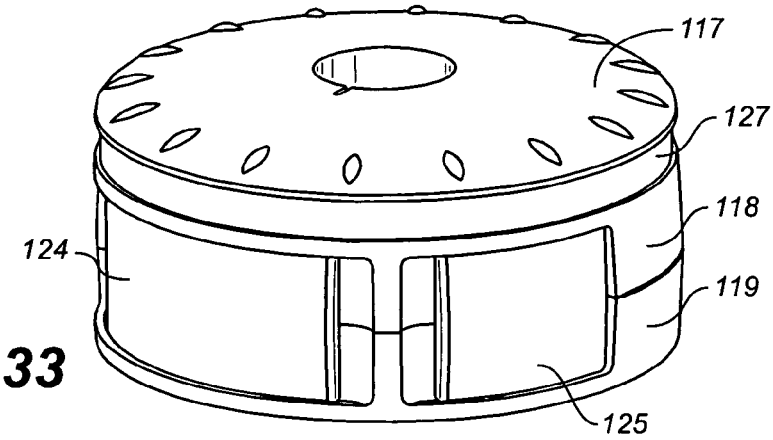
FIG. 33 is a front top perspective view of the power console shown in FIG. 27, with the sliding control panel doors closed.
Figure 34:
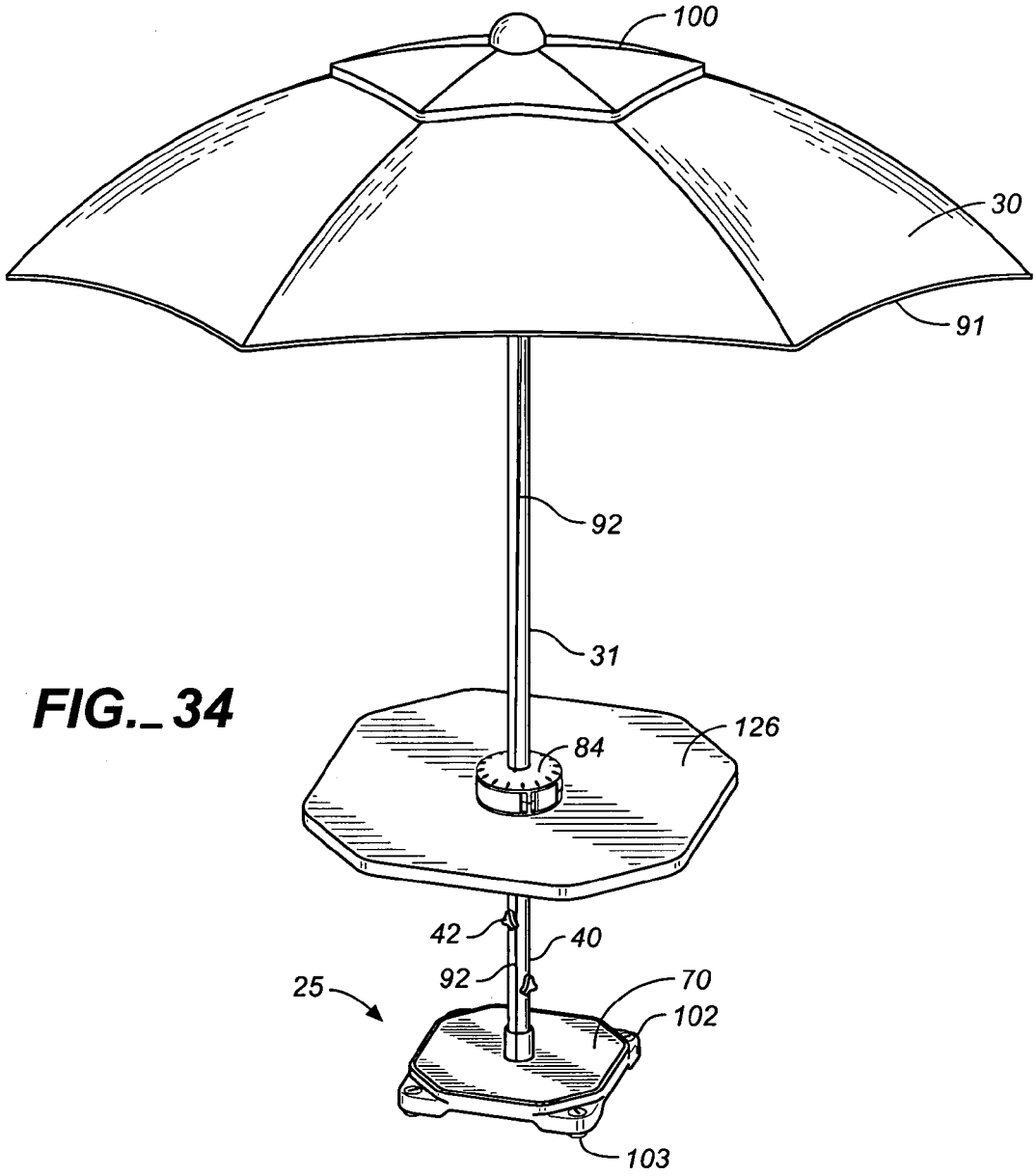
FIG. 34 is a top perspective view of an umbrella base holding an umbrella and table, and showing the power console on the table instead of the umbrella base.
Figure 35:
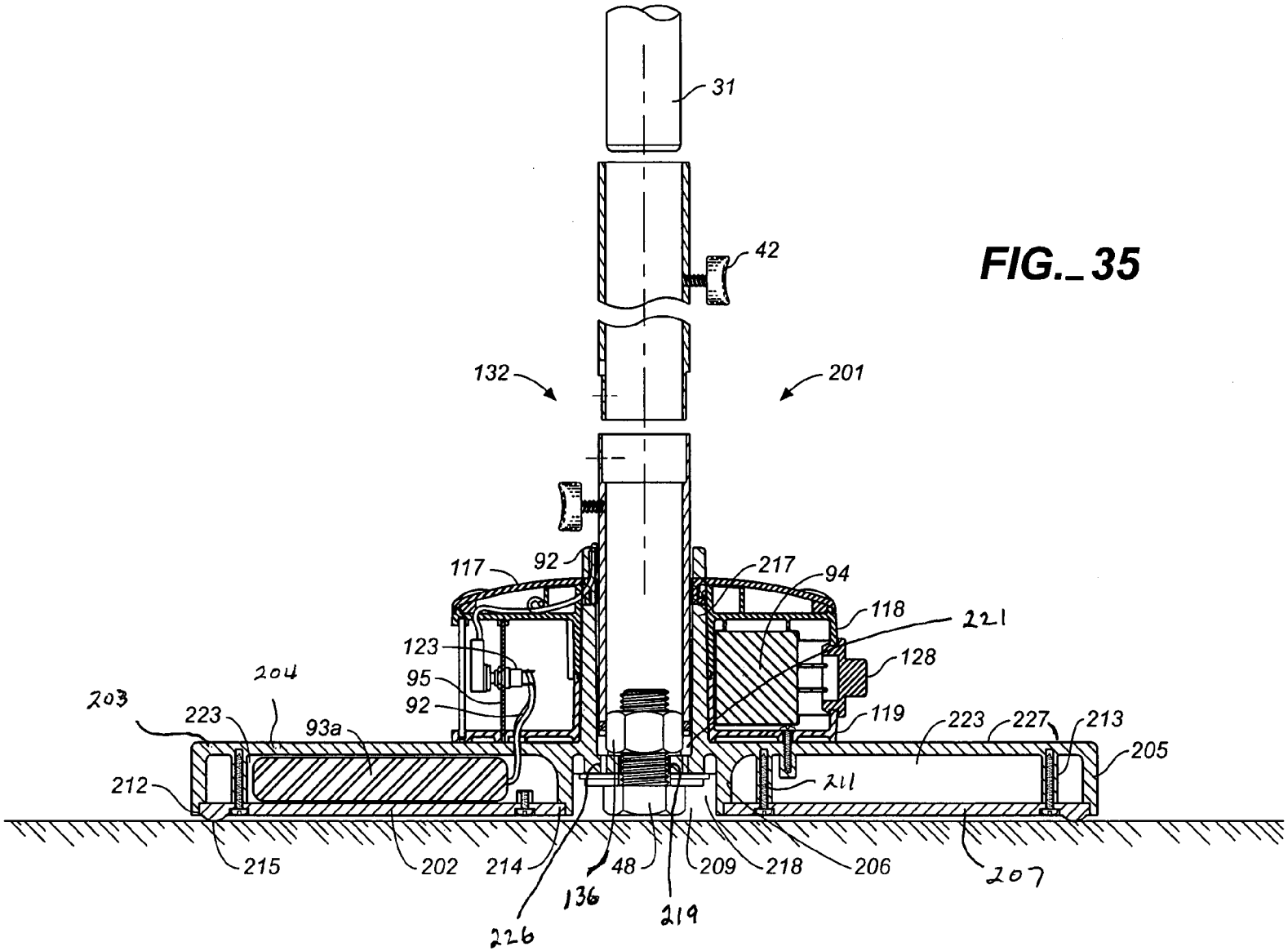
FIG. 35 is a cross-sectional view of a shallow profile, non-rolling umbrella base in accordance with the invention with batteries and a power console.

A power console 84 identical to that previously described and shown in FIGS. 27-34 can optionally be provided on the top of the umbrella base 201 shown in FIG. 35. Reference is made to that description in understanding the use of the power console on this version of the umbrella base.

Referring to FIGS. 27-33, after the power console 84 is connected to rolling umbrella base 25, the top 117 of the power console is removed from the upper housing 118 of the power console by a twisting motion to allow for the wires 92 to be threaded thought the upper housing 118 and connected to the control panel 95. After the wires 92 are attached, the top 117 can be reattached to the upper housing 118 by a downward and clockwise motion as illustrated in FIG. 28. In doing so, one or more fingers 120 (See FIG. 27) located on the underside of top 117 cam lock under recesses 121 formed into the upper housing 118 to snap together thus hiding and protecting the wiring connections. In addition to the wires 92 rising up into the umbrella 30 to either provide power for lights or other electrical components, there can also be wires 92 interconnecting a solar cell 100 or small wind turbine to generate energy to supply power back into the battery packs 93 that are within the cavities 53 of umbrella base 25 to help maintain power for the lights, fans, computers, radios or other electrical components that the user may wish to use.

Figure 30:
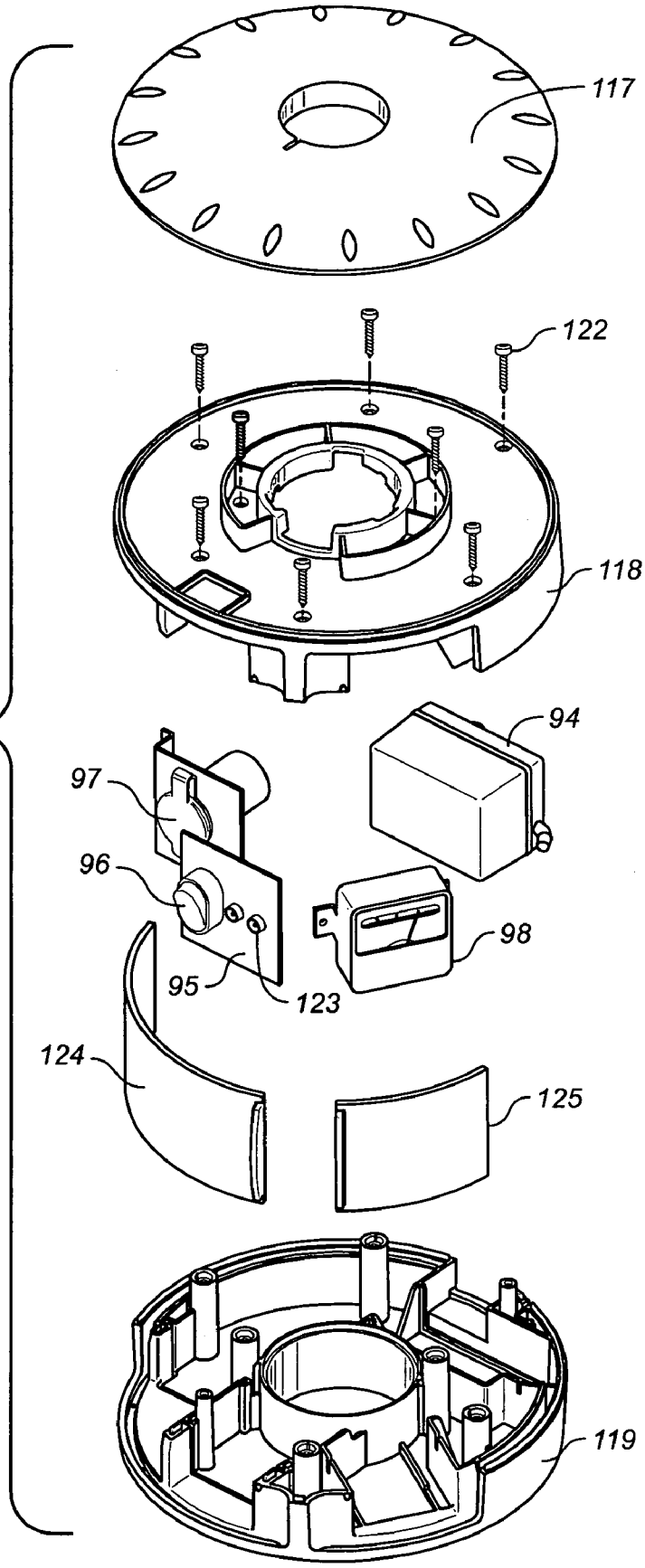
FIG. 30 is an exploded top perspective view of the power console shown in FIGS. 30 and 31.
Figure 31:
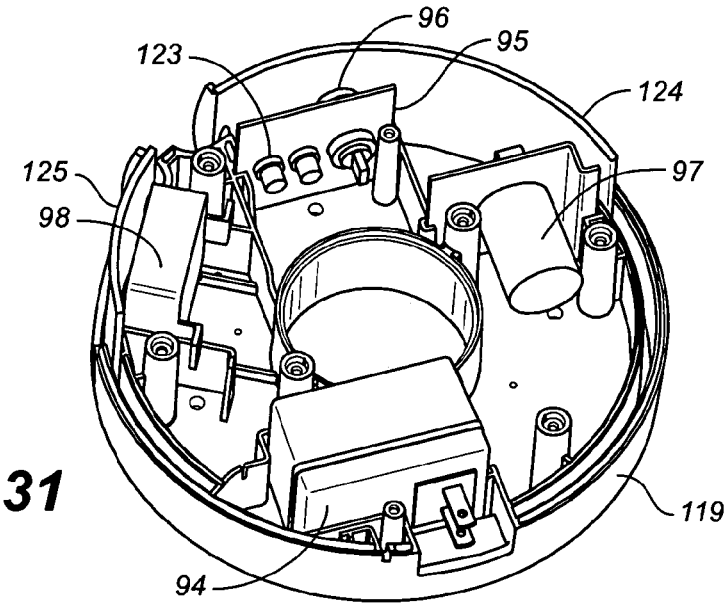
FIG. 31 is a bottom perspective view of the upper section of the console housing showing the electronic components packed therein.
Figure 32:
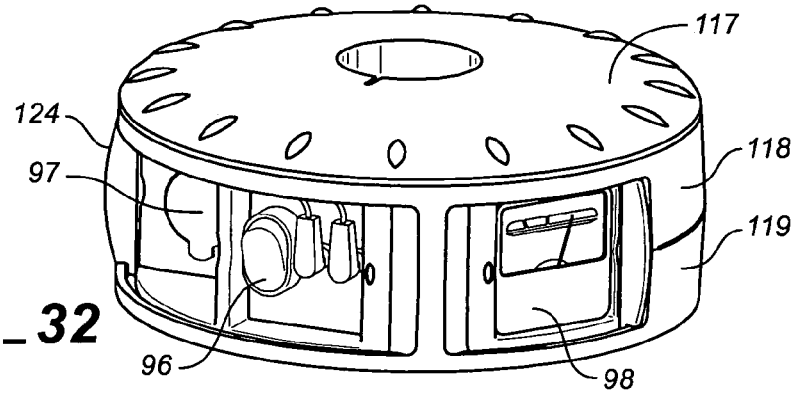
FIG. 32 is a front top perspective view of the power console shown in FIG. 27, with the sliding control panel doors open.

As best seen in exploded view FIG. 30, the power console 84 contains a lower housing 119 that contains the electrical components between it and the upper housing 118 by means of attachment screws 122. The illustrated embodiment shows but is not limited to a control panel 95 that includes an on/off switch 96 and 2 RCA type connectors 123. In addition the console shows a separate 12 volt receptacle 97 that can be used to run many devices from laptop computers to charging cell phones etc. This receptacle 97 allows for the external use of a plug in inverter not shown that would allow the user 120-volt capability without the need to incorporate an inverter within the umbrella base 25 as previously discussed. The console assembly 84 also shows a charging meter 98 for showing the power status of the batteries 93 in the base and a transformer 94 allowing the user to connect to a 110-volt power source to recharge the batteries 93. Also shown is a sliding door 124 that is used to open and close access to the control panel 95 and 12-volt receptacle 97. In addition another sliding door 125 is used to access the power meter. These doors are used to help protect the electrical components from the harsh outdoor elements but it is understood that other known configurations in the arts would also work satisfactory.

As described previously, the power console 84 helps the user manage his power needs by providing different power options. Another embodiment as shown in FIG. 34, shows a rolling umbrella base 25 under a table 126 with the power console 84 attached to the topside of the table 126. This embodiment allows the user to easily move his table along with his umbrella to any location he or she wishes. The table offers a work place for charging his laptop or cell phone while providing similar capability, as he would have in his car or RV. The rolling umbrella 25 contains the electrical source (i.e., batteries) while the umbrella provides shade and possible solar cells to recharge his power source 93. Also FIG. 33 shows another embodiment of the power console 84 with the addition of a lighted ring 127 that radiates light onto the table work surface or if attached to a umbrella base 25 would help light the surrounding area as darkness arrives in the evenings. It is understood that this power console 84 and its components can be constructed to be part of the top cover portion 60 or lower housing 50 or any part of umbrella base 25 without deviating from the scope of this invention.

FIG. 35 illustrates the use of the power console 84 on a shallow-profile, non-rolling umbrella base. In this embodiment of the umbrella base, the umbrella base 201 has a body portion in the form of a housing assembly, which includes an upper portion in the form of a housing top 203 having a flat top wall 204, downwardly extending sidewalls 205, and a downwardly inner ring wall 206. The housing assembly further has a lower portion in the form of a bottom cover plate 207 having a center opening 209, This cover plate is removably attached to the housing top 203 by means of attachment screws 211 that screw into screw bosses 213 formed on the underside of the housing top wall 204. Molded-in support feet 215 are suitably provided around the bottom perimeter edges of the bottom cover plate to raise the base slightly when placed on a hard potentially uneven surface. It is noted that the bottom cover plate is sized such that its outer perimeter edge 212 and inner edge 214 mate with and seal against the notched bottom edges 208, 210 of the housing top's sidewalls 205 and inner ring wall 206 when the attachment screws 211 are tightened.

To provide an umbrella shaft holding structure for this embodiment, an upwardly projecting central sleeve 217 is integrally formed on the top wall of housing top 203 for receiving a split umbrella shaft support pipe 132 that is essentially identical to the split support pipe described above in connection with the embodiment of the invention shown in FIGS. 20-26. As in this previously described embodiment, the bottom end of the bottom section of the split support pipe is secured in central sleeve 217 by means of cap screw 48, which is passed through bottom opening 219 in the sleeve structure and then screwed into the threaded nut 136 projecting from the bottom end of the split pipe. The projecting nut engages anti-rotating ribs 221 formed at the bottom of the sleeve structure to prevent the pipe from rotating in the sleeve. It is also noted that the head of the cap screw is recessed in the center recess 218 formed behind the central sleeve structure, so that it does not touch the ground. Raised stand-offs (not shown) on underside of the bottom wall of the sleeve structure prevent the cap screw washer 59 from blocking drain holes 226 in the bottom wall.

In this embodiment, one or more ballast cavities 223 are formed underneath the housing assemblies housing top 203. The illustrated partition walls (not shown) formed on the underside of the housing top's top wall divides the interior compartment underneath the top wall into separate ballast cavities 223, in which batteries 93*a* can be placed, and which can otherwise be filled with a desired ballast material. Adding batteries or otherwise filling the ballast cavities of this embodiment is accomplished by turning the base upside down, removing bottom cover plate 207 from the housing top 203, placing the batteries in the ballast cavities and, if desired, pouring additional ballast material, and replacing the bottom cover plate. The resulting weight of the base will depend on the weight of the batteries and the additional ballast material used, if any.

Both the housing top 203 with its integral sleeve structure 217, and the bottom cover plate 207 of the embodiment shown in FIG. 35 are suitably fabricated of inexpensive molded plastic parts. The housing top's top wall will provide a flat billboard surface 227 on which an advertising message can be provided, such as by a molded in logo or a laminated adhesive label, or by any other suitable means, examples of which are mentioned above. Also, it is contemplated that the ballast cavities of the umbrella base shown in these figures can be pre-filled by the manufacturer and the bottom cover plate permanently sealed to the housing top.

While the description above refers to particular embodiments of the present invention, it will be understood that many modifications may be made without departing from the spirit thereof. The accompanying claims are intended to cover such modifications as would fall within the true scope and spirit of the present invention.

We claim:

1. An umbrella base system capable of supplying electrical power to external electrical devices comprising an umbrella base including a body portion having a top, a bottom, and at least one ballast cavity, said ballast cavity stores at least one cordless electrical power source such that the power source held in said ballast cavity will provide ballast weight for the umbrella base, and further including an umbrella holding structure accessible from the top of said body portion for receiving the support shaft of an umbrella for holding the umbrella in an upright position, at least one readily accessible power connector associated with said umbrella base, said power connector including a receptacle to which external electrical devices used in the vicinity of the umbrella base system can be removably connected, and a conductive path extending from said ballast cavity through said body portion for electrifying the readily accessible power connector associated with said umbrella base from a cordless power source held in the ballast cavity of said umbrella base, wherein the cordless power source held in said ballast cavity provides power to the receptacle of said power connector for powering an external device connected to said receptacle.

2. The umbrella base system of claim 1 wherein the body portion of said umbrella base includes rolling means for moving the umbrella base from one location to another.

3. The umbrella base system of claim 2 wherein the rolling means for the body portion of said umbrella base further includes means for locking the umbrella base at a fixed location after the umbrella base has been rolled on said rolling means from one location to another.

4. An umbrella base system capable of supplying electrical power to external electrical devices comprising an umbrella base having a top, a bottom, and at least one cavity for adding a ballast weight to the umbrella base, and an umbrella holding structure accessible from the top of said umbrella base for receiving the support shaft of an umbrella for holding the umbrella in an upright position, at least one cordless electrical power source in said at least one ballast cavity, wherein said power source provides ballast weight for the umbrella base, a power console associated with said umbrella base having at least one readily accessible power connector including a receptacle to which external electrical devices used in the vicinity of the umbrella base system can be removably connected, and a conductive path between the cordless electrical power source in said at least one ballast cavity in the umbrella base and the power connector of said power console, wherein said cordless power source provides power to the receptacle of said power connector for powering an external device connected to said receptacle.

5. The umbrella base system of claim 4 wherein said power console includes switch means for switching an external electrical device connected to the receptacle of said power connector on and off.

6. The umbrella base system of claim 4 wherein said at least one power connector includes at least one D.C. power connector to which external D.C. electrical devices can be connected.

7. The umbrella base system of claim 6 wherein said D.C. power connector includes at least one plug-and-jack type of D.C. power connector.

8. The umbrella base system of claim 4 wherein said cordless electrical power source is a low voltage D.C. power source, wherein means are provided for converting the low voltage of said D.C. power source to a relatively high A.C.

voltage at said power console, and wherein said power console includes at least one readily accessible A.C. power connector.

9. The umbrella base system of claim 4 wherein said cordless electrical power source is a 12 volt D.C. power source and said power console includes at least one readily accessible 12 volt D.C. power connector to which external 12 volt D.C. electrical devices can be connected.

10. The umbrella base system of claim 4 wherein said umbrella base includes rolling means for moving the umbrella base and the power source contained therein from one location to another.

11. The umbrella base system of claim 10 further including means for locking the rolling means of the umbrella base at a fixed location after the umbrella base has been rolled on said rolling means from one location to another.

12. The umbrella base system of claim 10 wherein said power console is located on top of said umbrella base so as to move with said umbrella base when it is moved from one location to the other.

13. The umbrella base system of claim 4 wherein said power console is adapted to surround a support shaft of an umbrella held in the umbrella holding structure of said umbrella base.

* * * * *